US010100529B2

(12) United States Patent
Marchesi

(10) Patent No.: US 10,100,529 B2
(45) Date of Patent: Oct. 16, 2018

(54) REMOVABLE CLADDING SYSTEM

(71) Applicant: Renato Marchesi, Guastalla (IT)

(72) Inventor: Renato Marchesi, Guastalla (IT)

( * ) Notice: Subject to any disclaimer, the term of this patent is extended or adjusted under 35 U.S.C. 154(b) by 0 days.

(21) Appl. No.: 15/487,733

(22) Filed: Apr. 14, 2017

(65) Prior Publication Data

US 2017/0298634 A1 Oct. 19, 2017

(30) Foreign Application Priority Data

Apr. 18, 2016 (IT) ..... 102016000039689

(51) Int. Cl.

*E04F 13/08* (2006.01)
*E04F 13/12* (2006.01)
*E04F 13/24* (2006.01)

(52) U.S. Cl.

CPC ..... *E04F 13/0801* (2013.01); *E04F 13/086* (2013.01); *E04F 13/0814* (2013.01); *E04F 13/0894* (2013.01); *E04F 13/12* (2013.01); *E04F 13/24* (2013.01); *E04F 2201/0161* (2013.01)

(58) Field of Classification Search

CPC . E04F 13/0801; E04F 13/086; E04F 13/0814; E04F 13/0894; E04F 13/12; E04F 13/24; E04F 2201/0161

USPC .... 52/478, 506.05, 520, 539, 543, 545, 546, 52/547

See application file for complete search history.

(56) References Cited

U.S. PATENT DOCUMENTS 312,658 A * 2/1885 Sagendorph ..... E04D 3/362 52/520
3,417,531 A * 12/1968 Jones ..... A47F 5/0846 52/520
3,438,168 A * 4/1969 Tischuk ..... E04F 13/0803 52/394

(Continued)

FOREIGN PATENT DOCUMENTS

DE 24 09 028 A1 9/1975
DE 2409028 A1 * 9/1975 ..... E04F 13/0814
FR 2 776 748 A1 10/1999

OTHER PUBLICATIONS

English Abstract, for DE 24 09 028, 2 pages.

(Continued)

*Primary Examiner* — Charles A Fox
*Assistant Examiner* — Joseph J. Sadlon
(74) *Attorney, Agent, or Firm* — Ware, Fressola, Maguire & Barber LLP

(57) ABSTRACT

A cladding system for a wall includes a plurality of panels (3), each with first and second longitudinal edges blocked to each other and to the wall by a respective plurality of fastenings (5, 7). Removable fastening means (5) include a releasable clamping member (23) movable with respect to corresponding locking means (21) and movably joinable thereto so as to fix to the wall a concave housing means (15) of the first longitudinal edge (11) of a panel (3) that contains a first rib means (17) of the second longitudinal edge (13) of the other panel (3), the first rib being inserted in the concave housing means. The release of the releasable clamping members (23) from the respective locking means (21) of the plurality of removable fastening means (5) of the edges (11, 13) of the two adjacent panels (3) allows to release said edges (11, 13).

10 Claims, 18 Drawing Sheets

(56) References Cited

U.S. PATENT DOCUMENTS

| | | | | | |
|---|---|---|---|---|---|
| 4,267,679 | A * | 5/1981 | Thompson | E04C 2/292 | 52/478 |
| 4,283,897 | A * | 8/1981 | Thompson | E04B 1/80 | 52/478 |
| 4,411,117 | A * | 10/1983 | Bolha | E04G 23/02 | 52/459 |
| 4,607,471 | A * | 8/1986 | Olsen | E04F 13/0803 | 52/509 |
| 5,018,323 | A * | 5/1991 | Clausen | A47F 5/0846 | 211/189 |
| 5,191,745 | A * | 3/1993 | Story | E04F 13/0812 | 52/127.8 |
| 5,675,955 | A * | 10/1997 | Champagne | E04F 13/0864 | 52/519 |
| 6,301,853 | B1 * | 10/2001 | Simpson | E04C 3/08 | 52/520 |
| 6,393,792 | B1 * | 5/2002 | Mowery | E04F 13/18 | 52/506.05 |
| 6,968,659 | B2 * | 11/2005 | Boyer | E04C 2/292 | 52/235 |
| 7,614,191 | B2 * | 11/2009 | Mitchell | E04F 13/0826 | 52/127.8 |
| 9,803,372 | B2 * | 10/2017 | Griffiths | E04F 13/0862 | |
| 2014/0305063 | A1 | 10/2014 | Kim | | |

OTHER PUBLICATIONS

English Abstract, for FR 2 776 748, 2 pages.
Search Report and Written Opinion, ITUA20162682, completed Dec. 6, 2016, 8 pages.

* cited by examiner

FIG.4
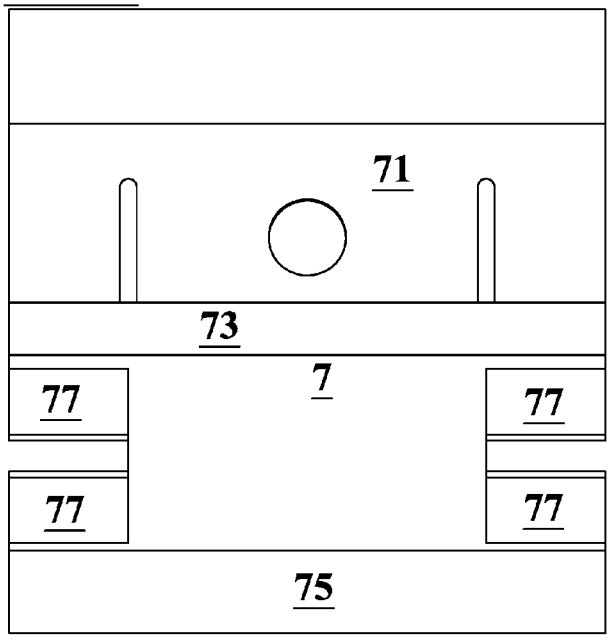
FIG.5
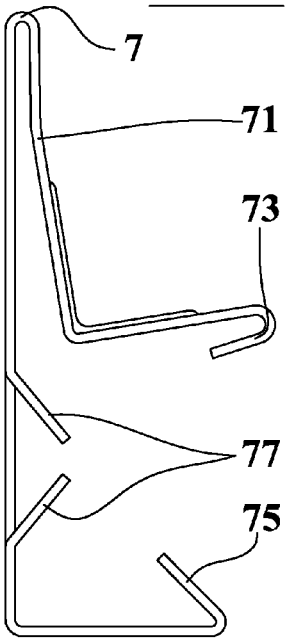
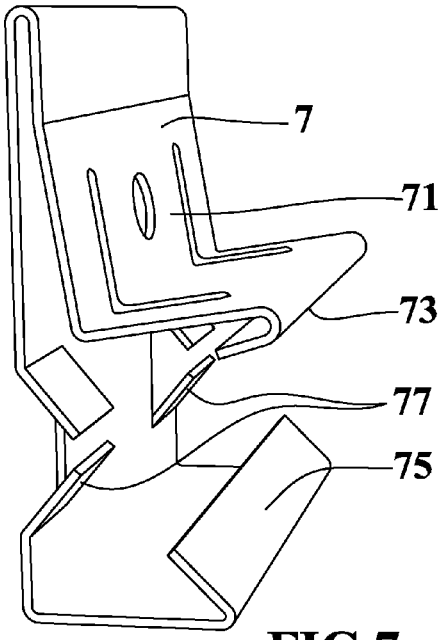
FIG.7
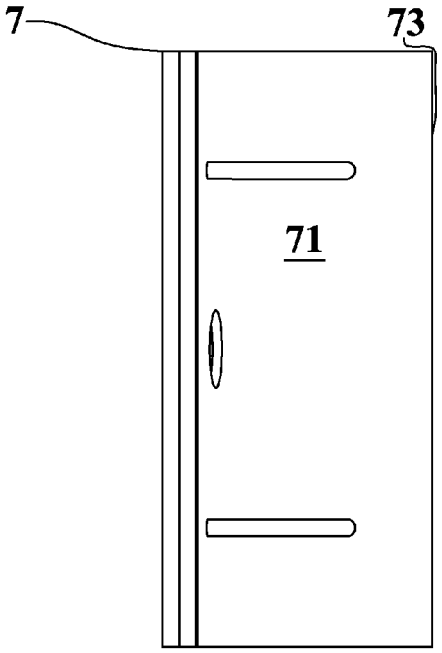
FIG.6

FIG.8
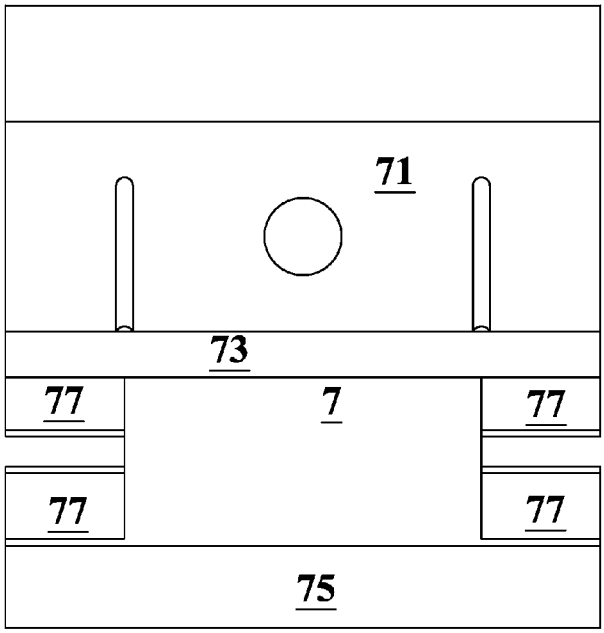
FIG.9
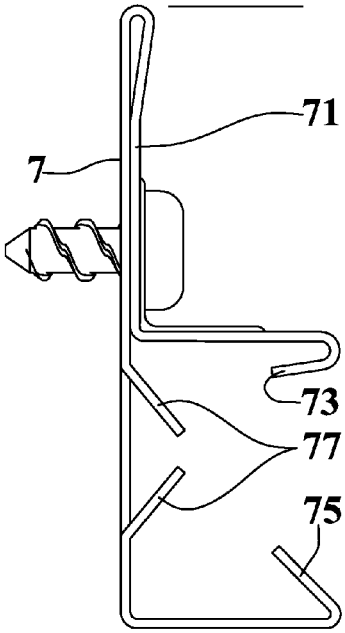
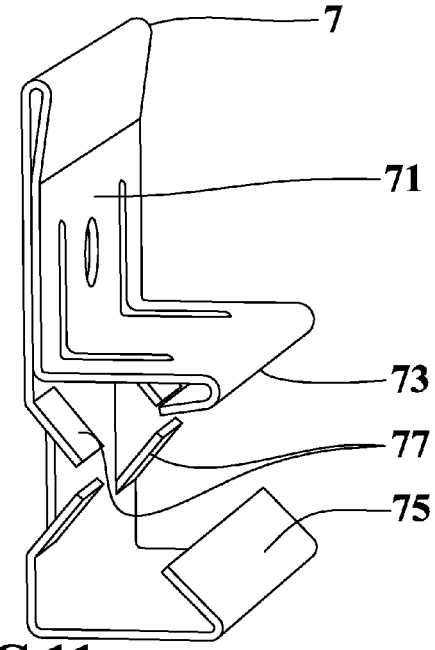
FIG.11
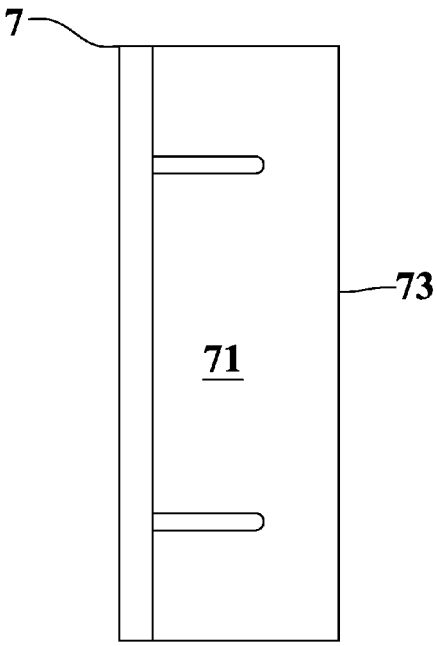
FIG.10

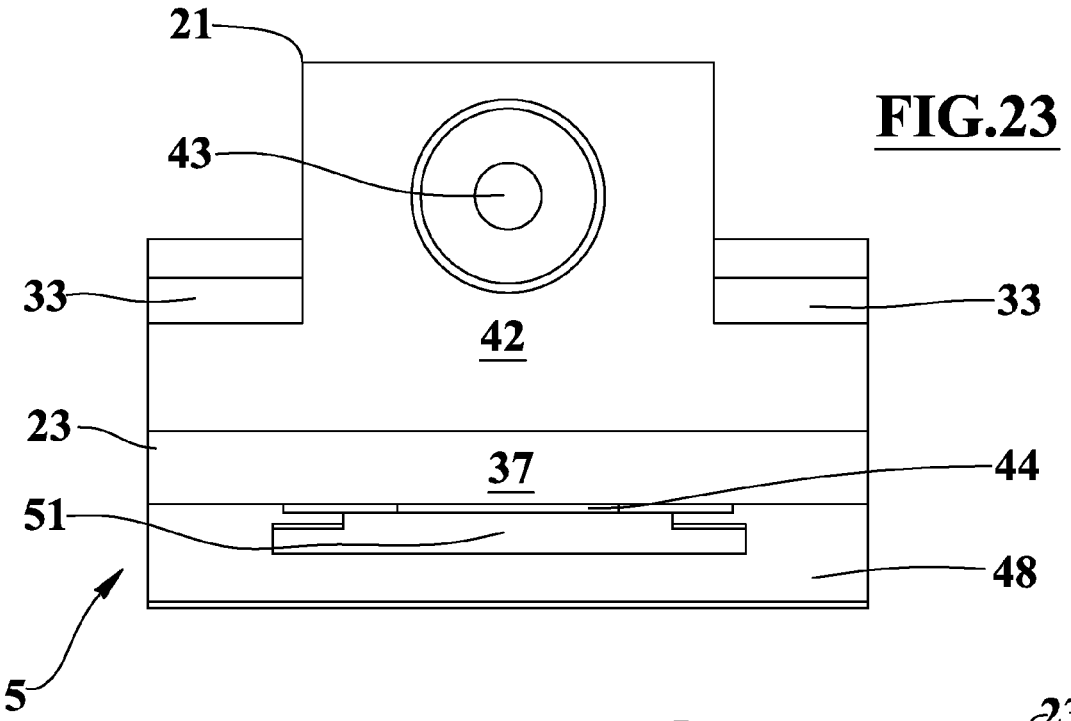
FIG.23
FIG.24
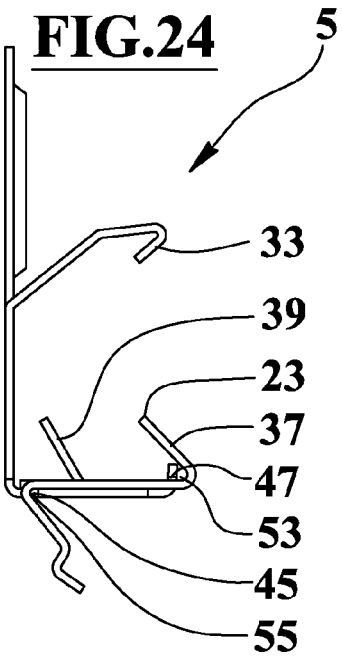
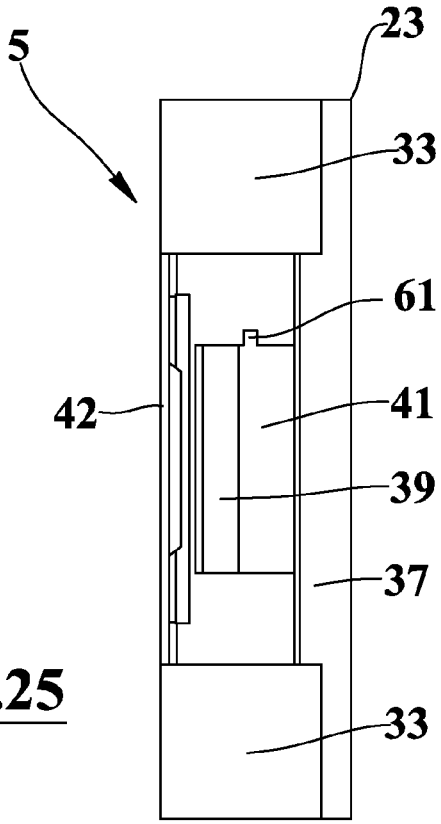
FIG.25

FIG.31
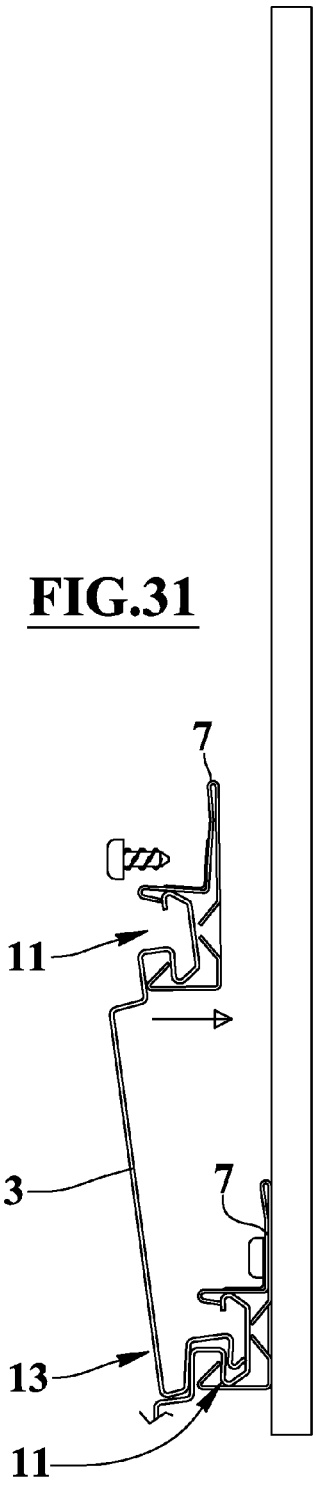
FIG.32
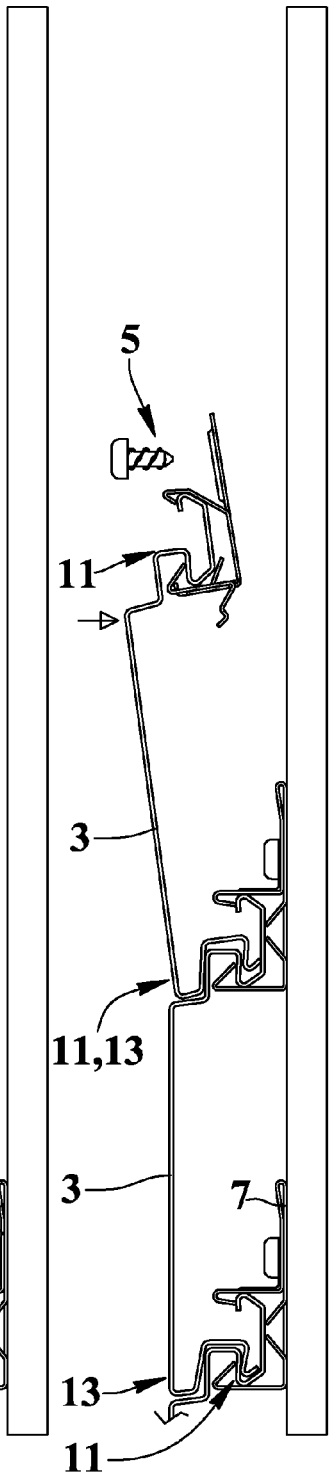
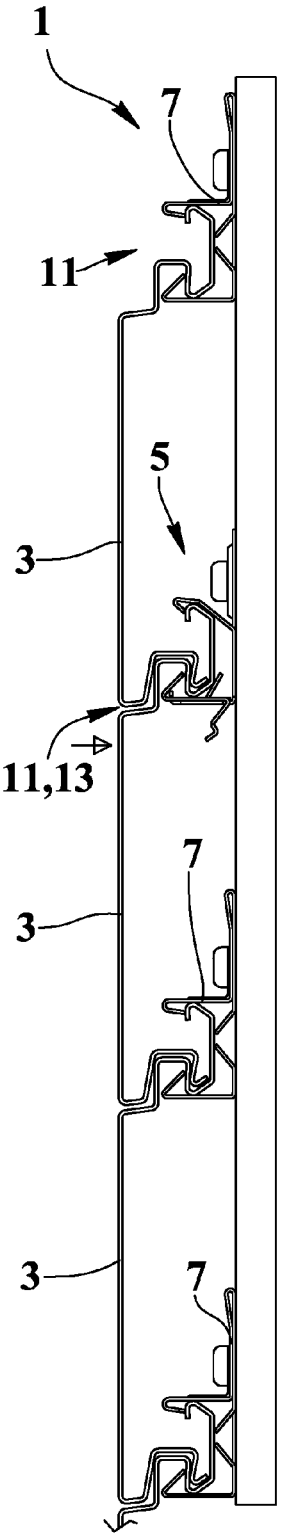
FIG.33

REMOVABLE CLADDING SYSTEM

BACKGROUND

The present invention relates to the field concerning the coatings which can be applied externally and/or internally to building works and it refers to a removable coating device or better to a removable cladding system and particularly suitable to cover walls and inner and outer ceiling of buildings and building works in general, for example made of reinforced concrete, prefabricated elements, bricks, varied building materials or works comprising or consisting of metal structures, of wooden beam and of other materials. For example the device can be directly fixed to a ceiling to clad it or it can be fixed to a metal structure to realize a false ceiling.

Coatings for outer walls constituted by panels, metal slabs or staves, generally made of aluminium sheet, fixed in an horizontal way to the wall by means of connections fixed to the wall and each engaged to the horizontal edges of two panels or adjacent sheets or to an upper or lower edge respectively of the upper and lower panel are known.

A disadvantage of such known coatings consists in the fact that the release of a panel, for example because of a necessary replacement owning to a damage or to access to the wall or to elements fixed to this latter, needs the disassembly of all of the upper or lower panels to the one to remove.

Another disadvantage of some of such coatings consists in the fact that they are difficult to apply and they need a lot of time of an appropriately trained staff.

SUMMARY

An object of the present invention is to propose a coating or, in other words, to a removable cladding system device which allows the release of even of just one and any panel of the coating in use.

Another object is to propose a removable coating device which allows to remove any panel by means of preliminary removal of a maximum number of other upper or lower panels of the coating in use.

Documents US 2014/305063 A1 and DE 24 09 028 A1 disclose a coating device having the features of the preamble of claim 1.

Further object is to propose an easy and fast wall fitting device for the installation of the coating.

Another object is to propose a device almost free from the risk of damage of the walls or slabs because of the thermal expansion not having edges or ends submitted to mechanical direct wall fixing or for another bearing structure.

Further object is to propose a hidden fixing device which, when in use, exposes to the sight only the panels or slabs.

BRIEF DESCRIPTION OF THE DRAWINGS

The characteristics of the invention are underlined below with particular reference to the enclosed drawings in which:

FIGS. 4-7 show respectively front, lateral, from the top and axonometric views of a fixed connection means of the device of FIG. 2 in a non-operative condition;

FIGS. 8-11 show respectively front, lateral, from the top and axonometric views of the fixed connection means of FIG. 4 in an operative condition;

FIGS. 23-27 show front, lateral, from the top views and axonometric views, from respective points of view, of the removable connection means of FIG. 14, whose members are in a condition of mutual engagement and joint;

FIGS. 31-33 show lateral views of a possible sequence of installation of a possible configuration of the device with three panels;

DETAILED DESCRIPTION

Figure 1:
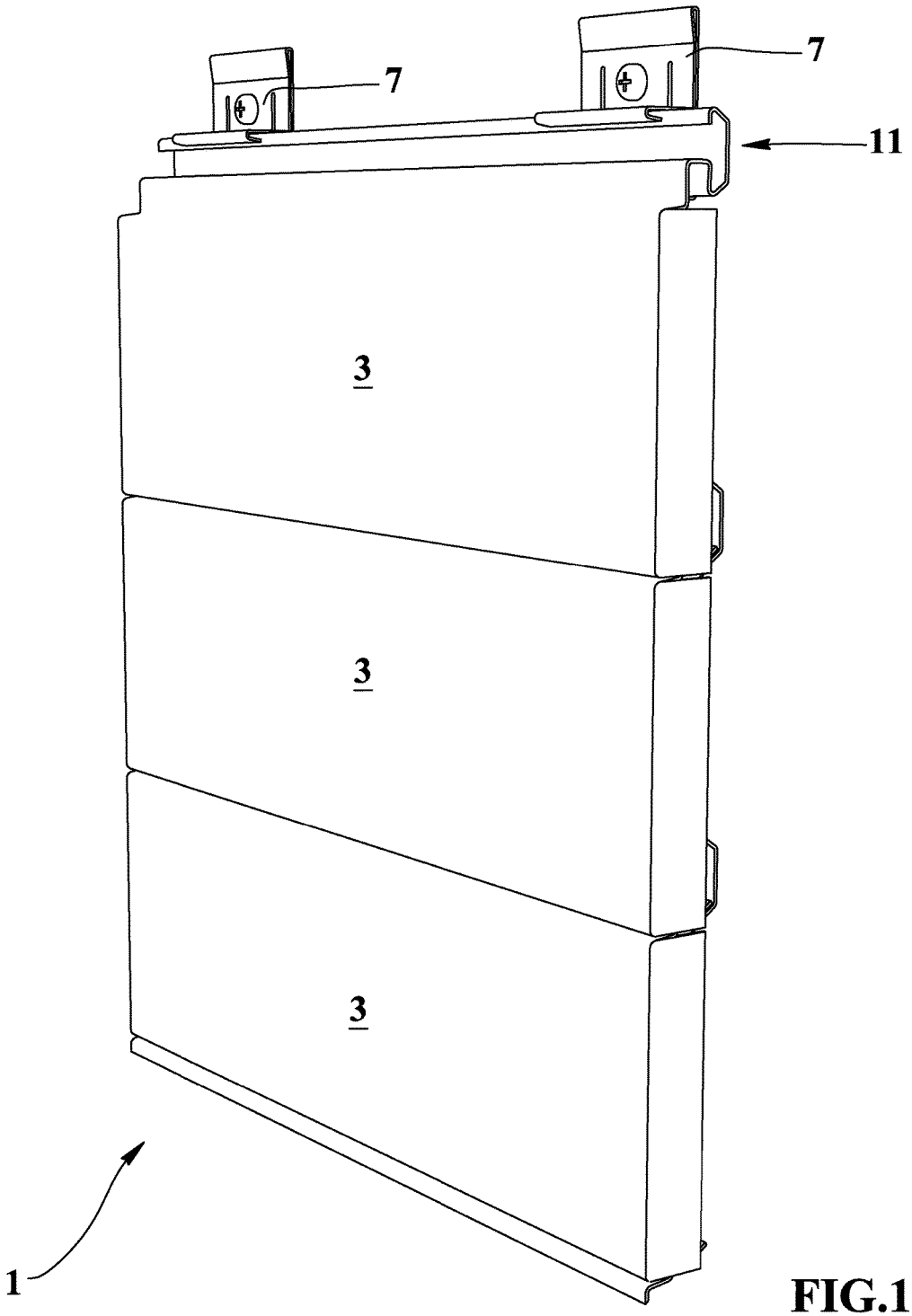
FIG. 1 shows a frontal and perspective view of the removable cladding system or coating device, object of the present invention, constituted by three horizontal and overlapping panels.

With reference to FIGS. 1-39, 1 indicates the removable cladding system, or removable coating device, for a wall or building or furniture work object of the present invention The device 1 comprises a plurality of panels 3 made, for example, of synthetic material or preferably of a metal type or comprising at least one metal portion or eventually a portion of organic material of synthetic or natural origin such as wood and its by-products.

In particular the panels 3 can be obtained by punching, or otherwise cutting, and bending aluminium (or its alloys) slabs, anodized or painted, steel sheets or made of stainless steel covered, oxidized, painted or with the stainless steel exposed, of zinc titanium or of other alloys and materials.

The following description and the figures show in an exemplifying way flat slabs, rectangular and elongated with bended and shaped edges and disposed, in a fitting condition to a wall of a building work or furniture work, with the longitudinal edges, or longest, which are horizontally arranged.

Alternatively, the invention provides that the slabs could be also undulated, embossed, drilled, drawn, subjected to nibbling or with face in view in every nature and shape or covered and which can be mounted with any orientation, even vertical or with any inclination.

Hereinafter the terms upper and lower will be used only with a descriptive and non-limitative aim and they refers to the arrangement of the panels on a vertical plane and with longitudinal edges arranged in a horizontal way as shown in the figures in an exemplifying way.

The upper and lower longitudinal edges of the panels 3 are dissimilar to allow the lower edge of a panel to house and hook itself to the upper edge of a panel below but the invention provides that, mutatis mutandis, also the contrary or the coupling of the edges vertically arranged or inclined.

The longitudinal edges of two adjacent panels 3 mutually touch each other and are locked to the wall and one to each other by means of a respective plurality of fastenings 5, 7.

Each panel 3 is equipped with a first longitudinal edge 11 which is shaped to couple, for instance in a horizontal orientation, to a second longitudinal edge 13 of an adjacent panel when assembled as shown. The first longitudinal edge 11 runs along an upper horizontal edge of each panel. In the assembled condition the first longitudinal edge 11 is positioned above the respective second longitudinal edge 13 which is shaped to run along a lower horizontal edge of each panel, so that for the example horizontal orientation illustrated, it is positioned lower than and parallel to the first longitudinal edge 11.

The first longitudinal edge 11 has at least one concave housing means 15 and the second longitudinal edge 13 has a first rib means 17 whose shape is approximately complementary to the one of the concave housing means 15.

Such configuration provides that in the operative condition the first rib means 17 of a panel is inserted into the concave housing means 15 of the adjacent panel to form a couple. The concave housing means 15 and the first rib means 17 are shaped as a bevelled elongated prism, in other words they have longitudinal flat sides mutually jointed by rounded bevels.

The edges of two adjacent panels 3 of the system or device in the operative condition, are constrained by the fact that the first rib means 17 of one of them 3 is housed into the concave housing means 15 of the other one 3 and they are mutually fixed to the wall by means of a respective plurality of fastenings 5, 7. The invention, to obtain a covering in which each panel is directly removable, provides that all of the fastenings could be of a removable fastening means 5, for example shown in FIGS. 14-30.

Alternatively the invention provides that some couples of edges of adjacent panels are constrained by said removable fastening means 5 and other couples of edges are constrained by fixed fastenings 7 shown in an exemplifying way, previous to the operative condition and in the operative condition, in FIGS. 4-13.

Figure 2:
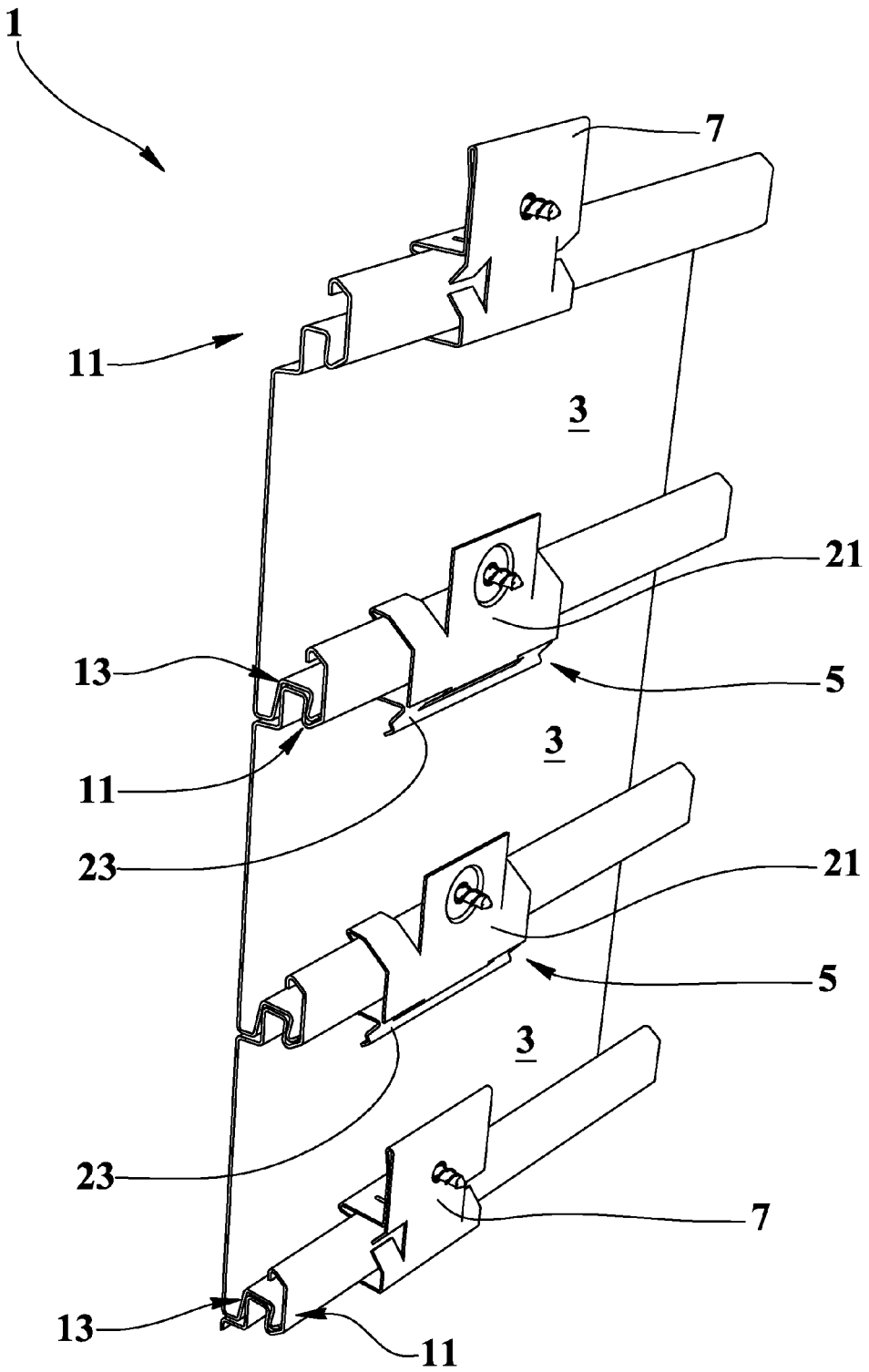
FIG. 2 shows a partial, rear and perspective view of the coating device of FIG. 1.
Figure 3:
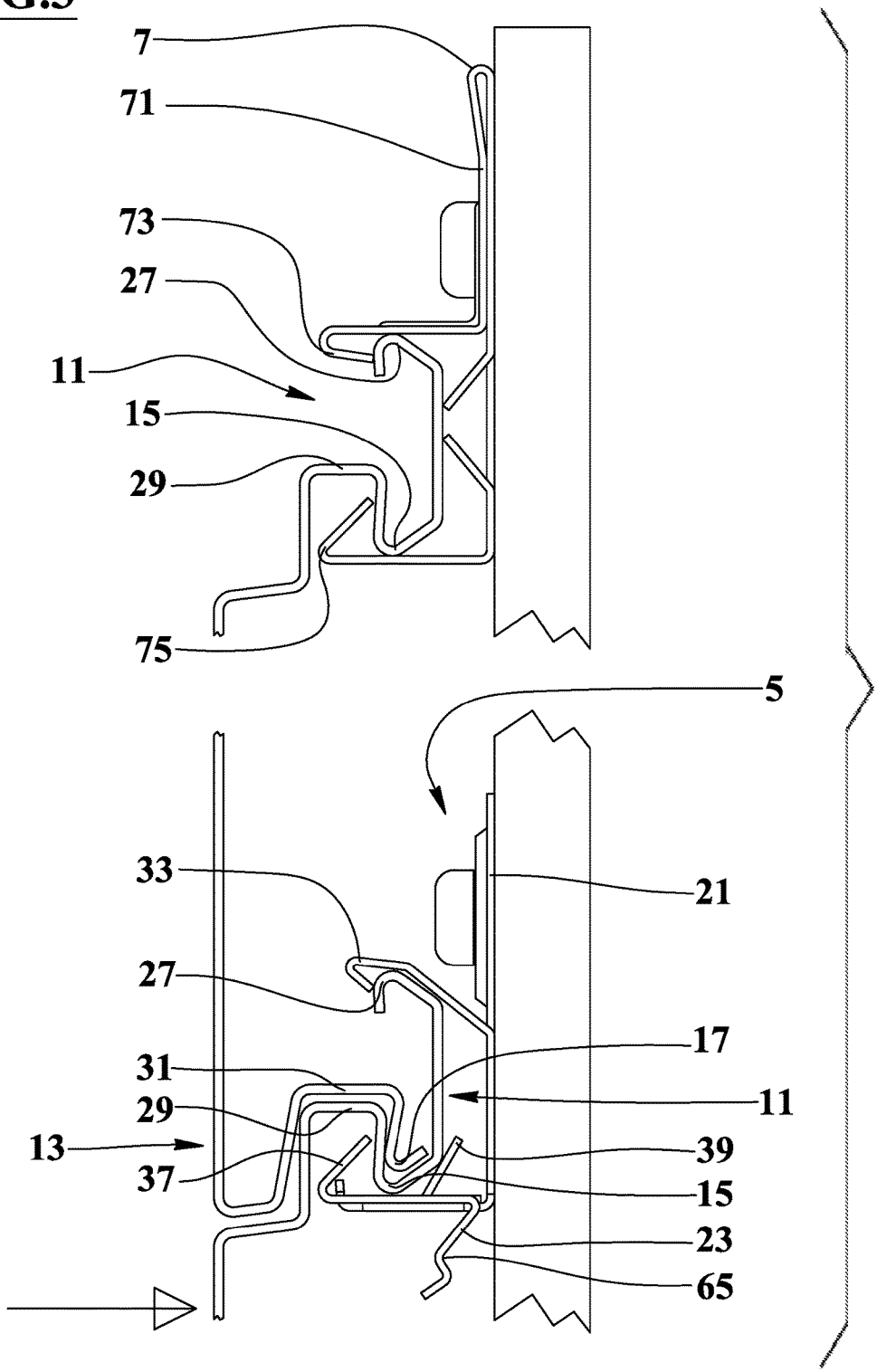
FIG. 3 shows a partial, enlarged and lateral view of the edges of the upper panel of FIG. 2.
Figure 13:
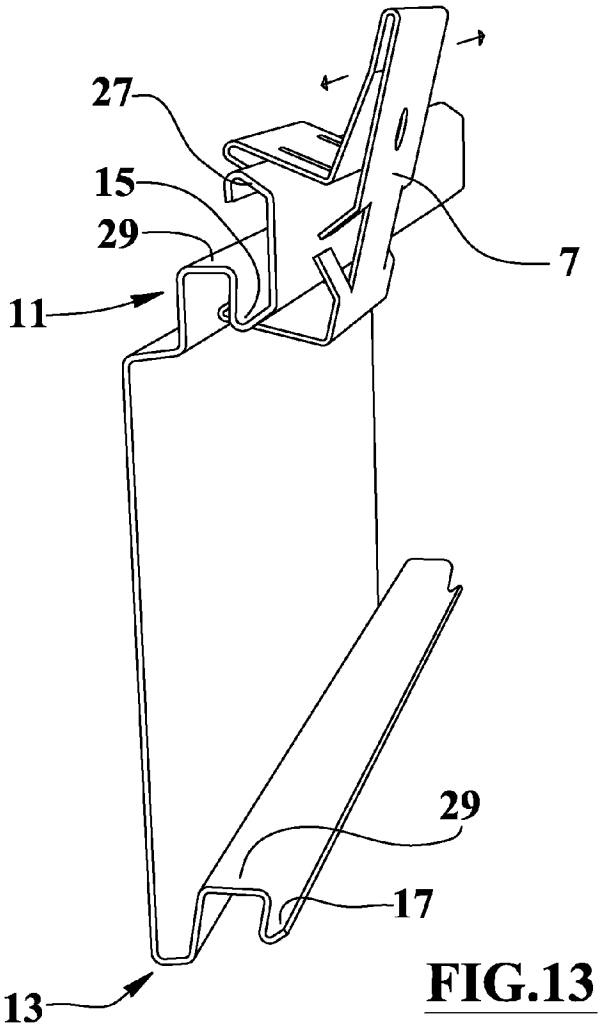
FIGS. 12 and 13 show axonometric views of the fixed connection means of FIG. 4 associated to an upper edge of a panel of FIG. 1 in a preceding condition of the one in use.
Figure 12:
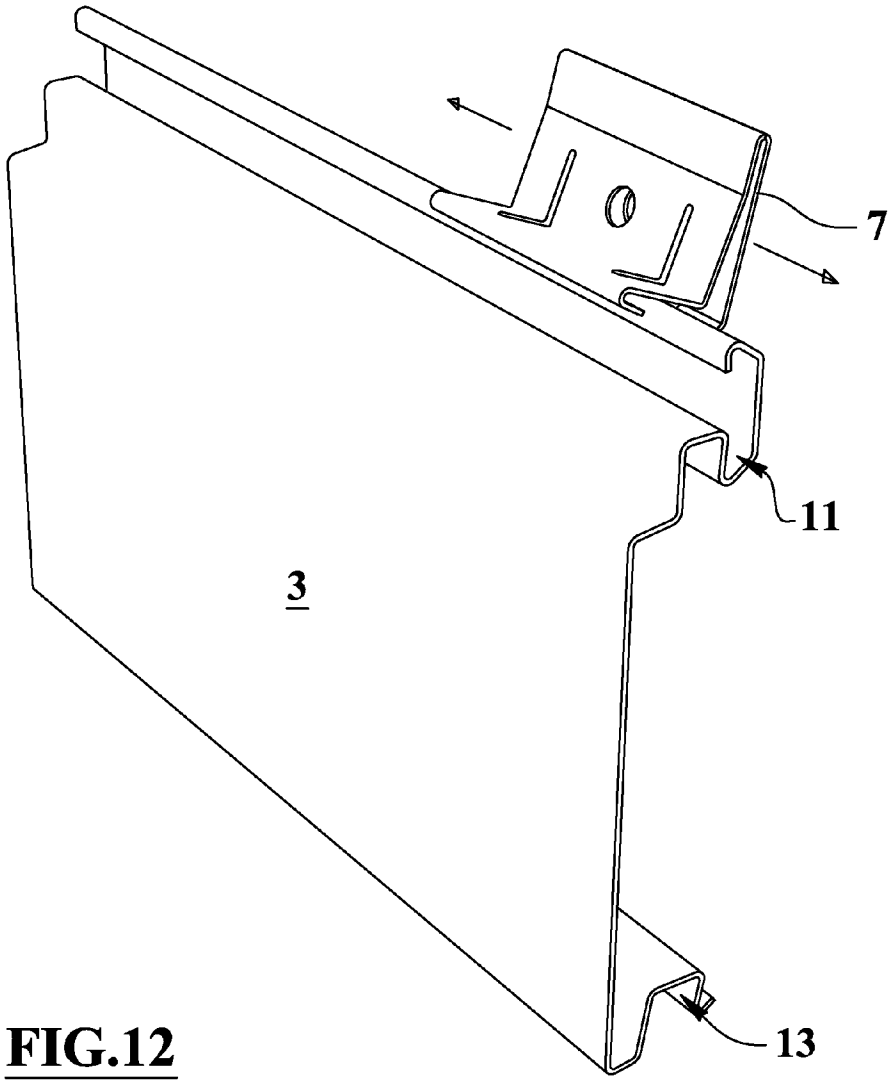
Figure 14:
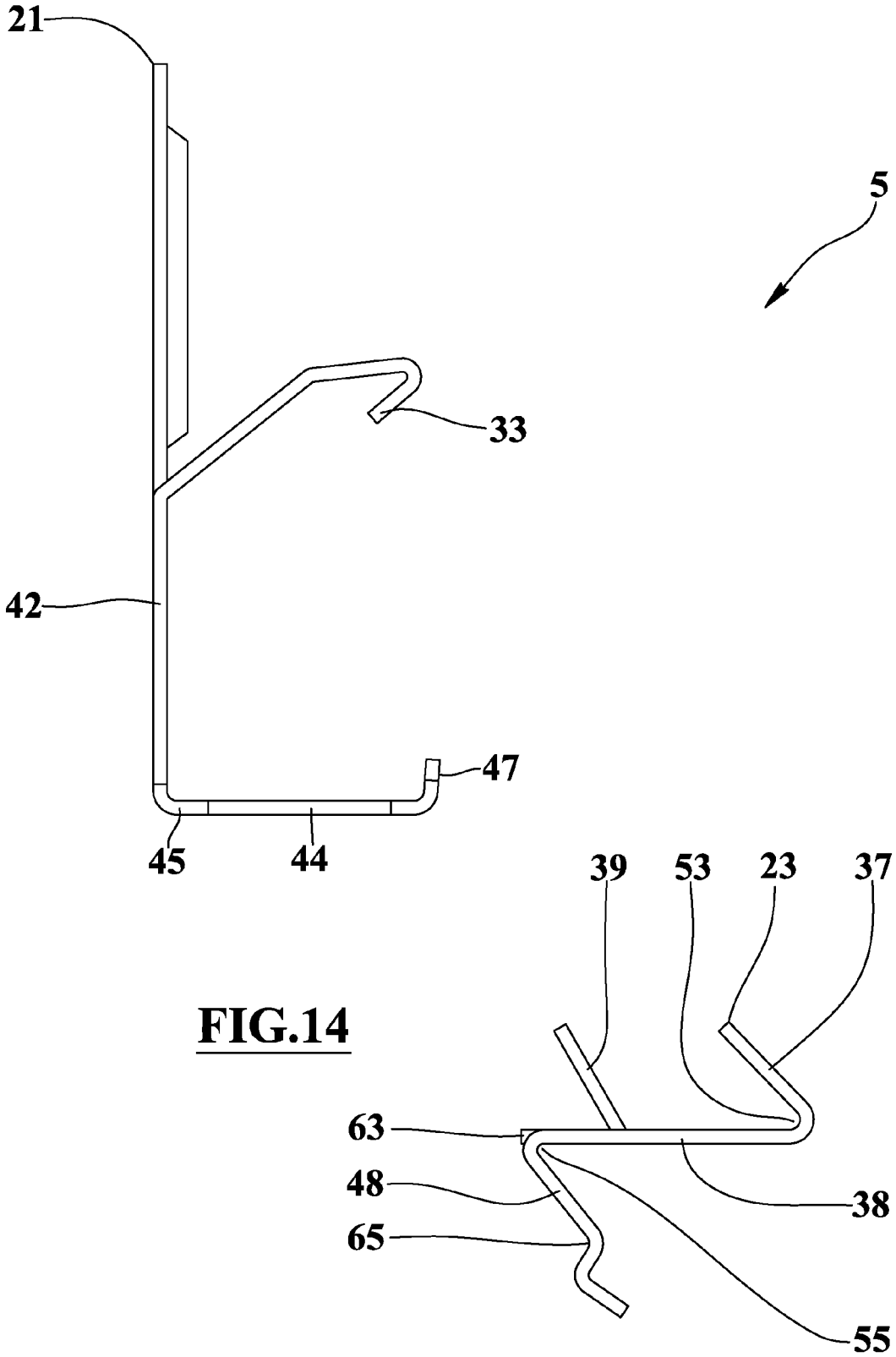
FIG. 14 shows a lateral view of a removable connection means of FIG. 2 constituted by a blocking member and by a joint member, mutually movable, shown in a mutual release condition.
Figure 15:
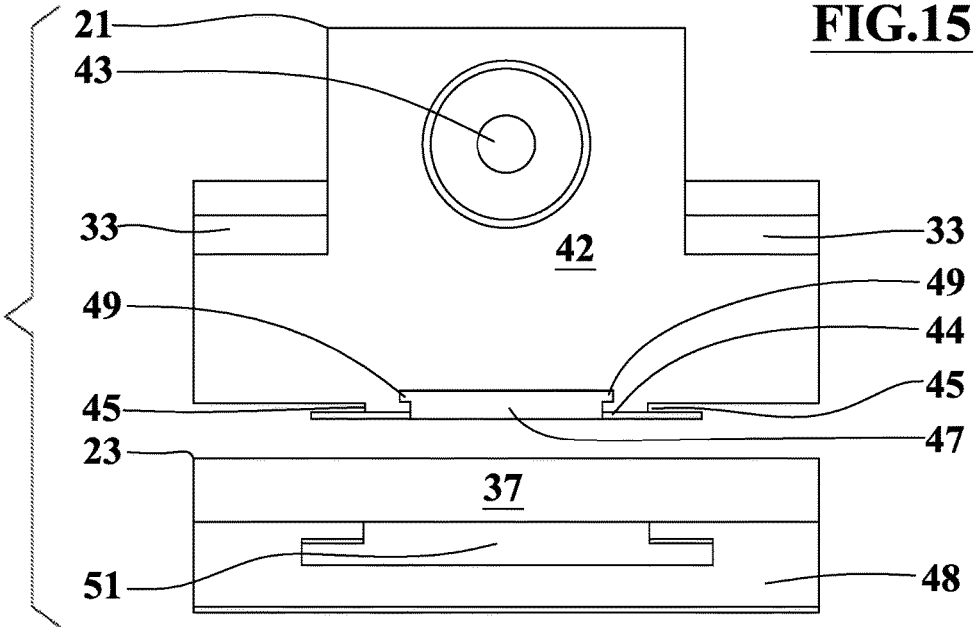
FIGS. 15-18 show respectively front view, in other words from a point of view which is oriented towards the device in his operative condition on a wall, rear view, from the top and from the bottom views of the removable connection means of FIG. 14.
Figure 16:
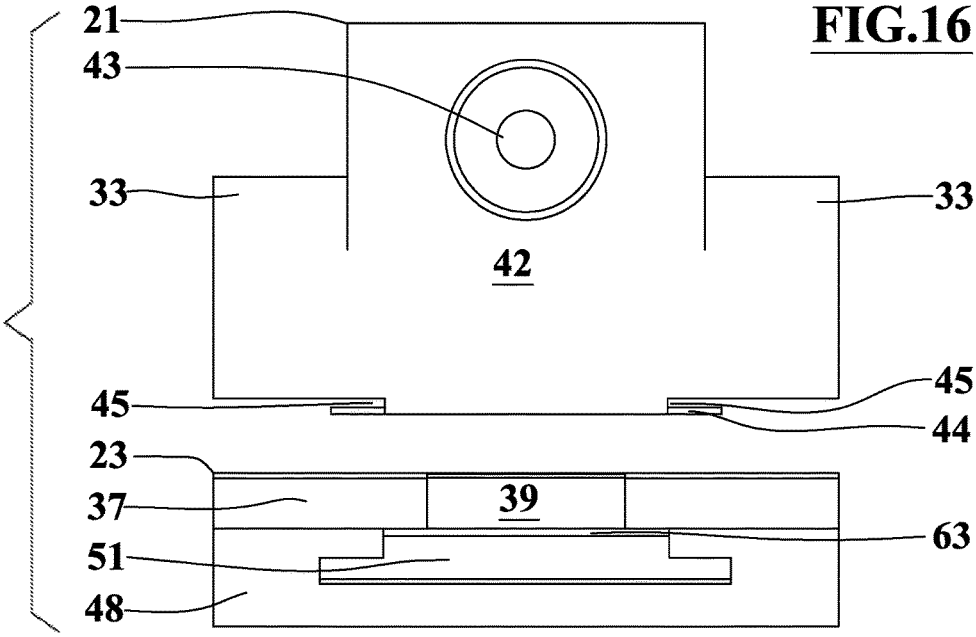
Figure 18:
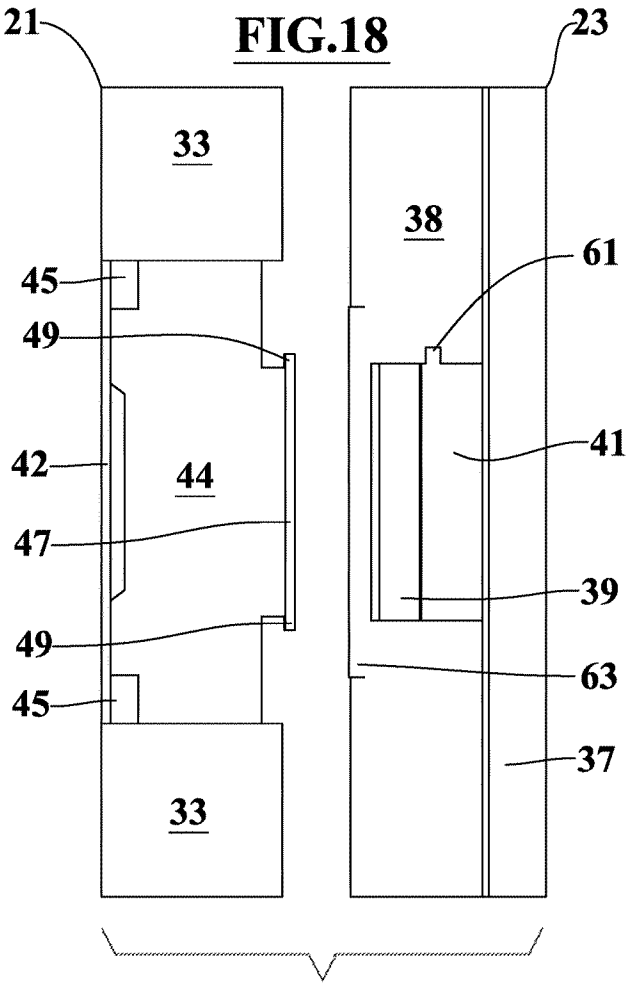
Figure 17:
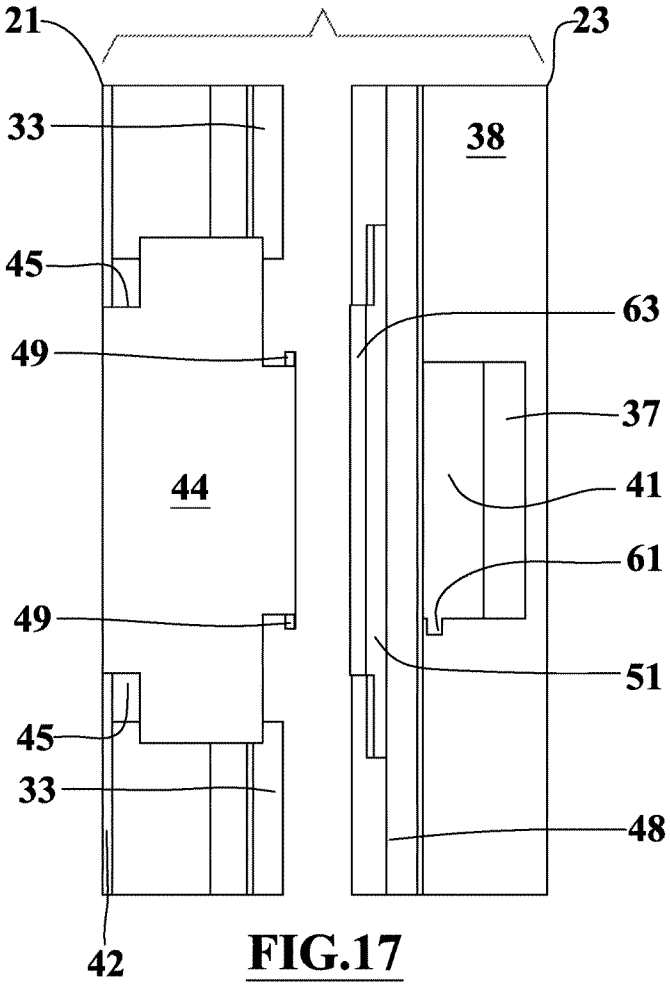
Figure 20:
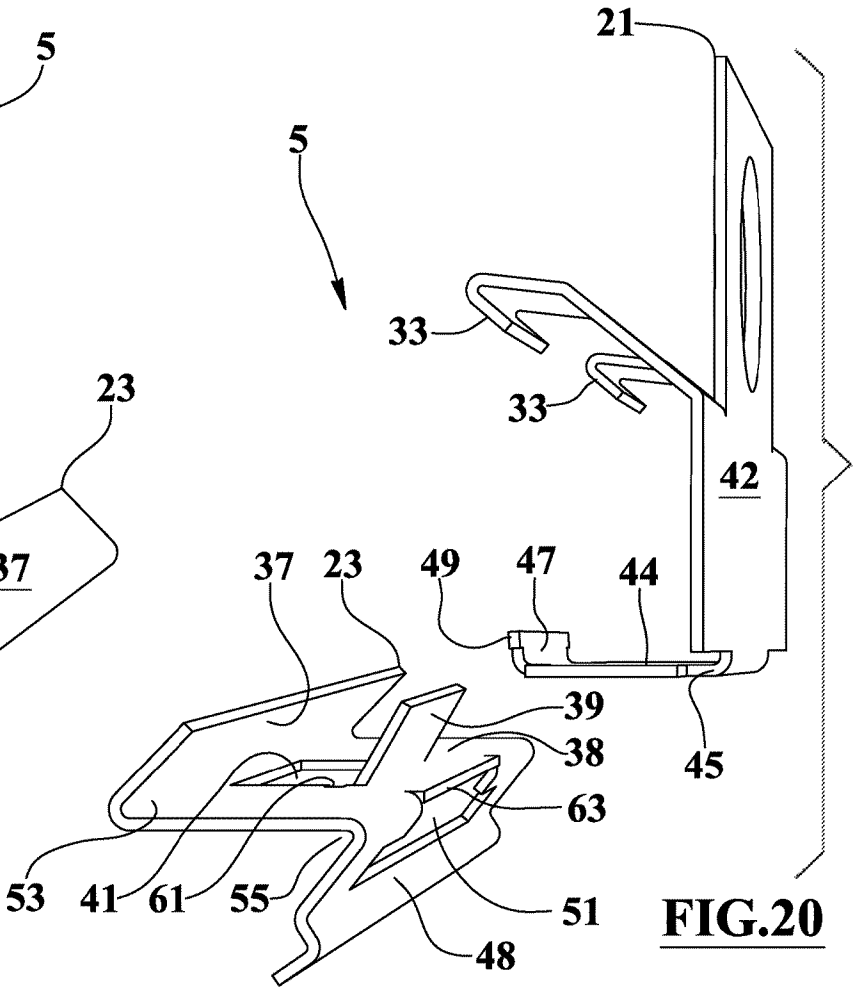
FIGS. 19-22 show perspective views, from respective points of view, of the removable connection means of FIG. 14.
Figure 19:
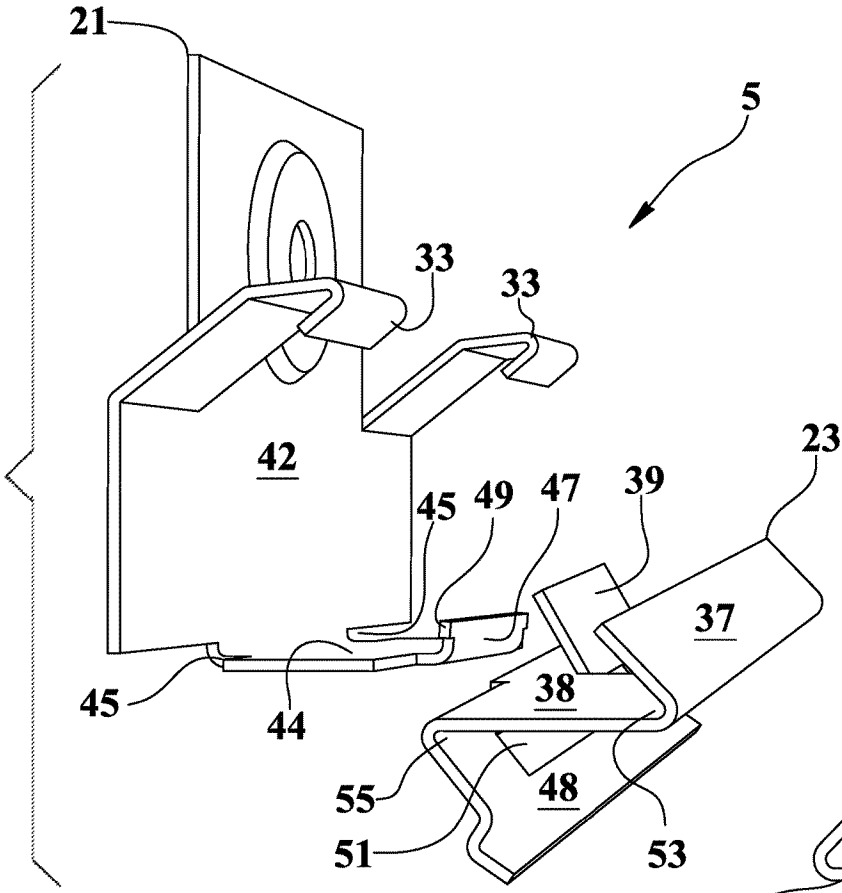
Figure 22:
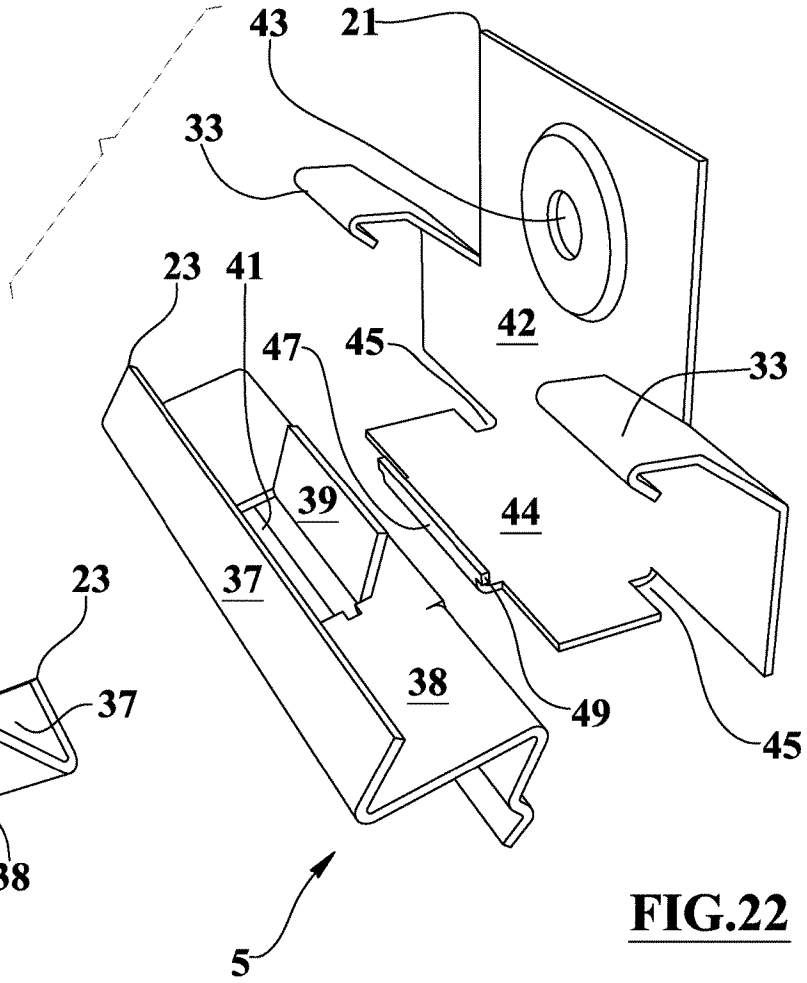
Figure 21:
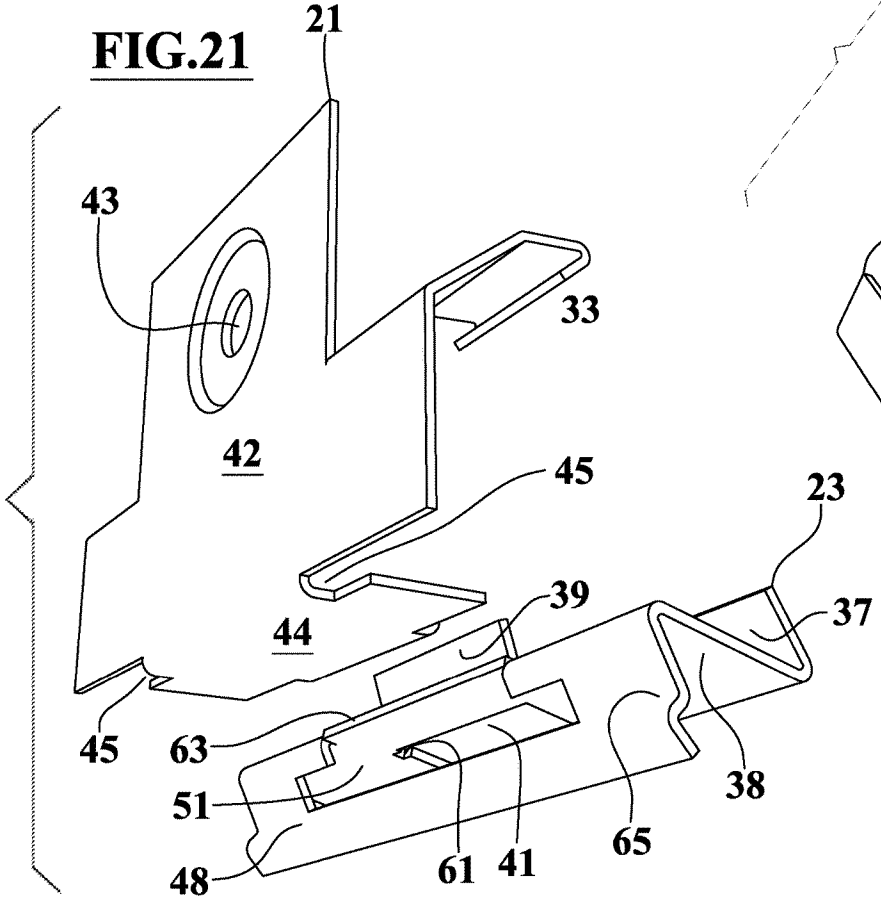
Figure 27:
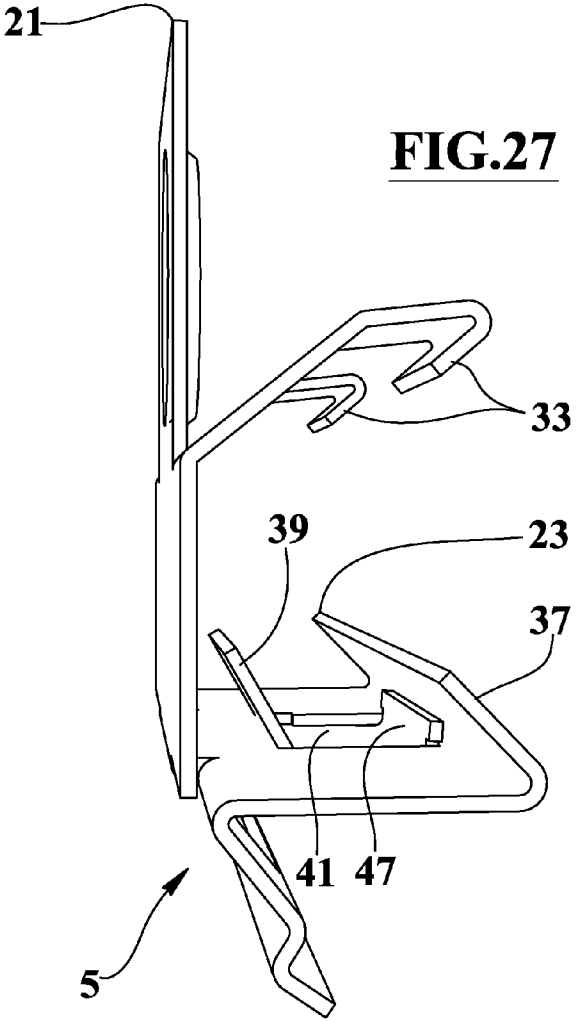
Figure 26:
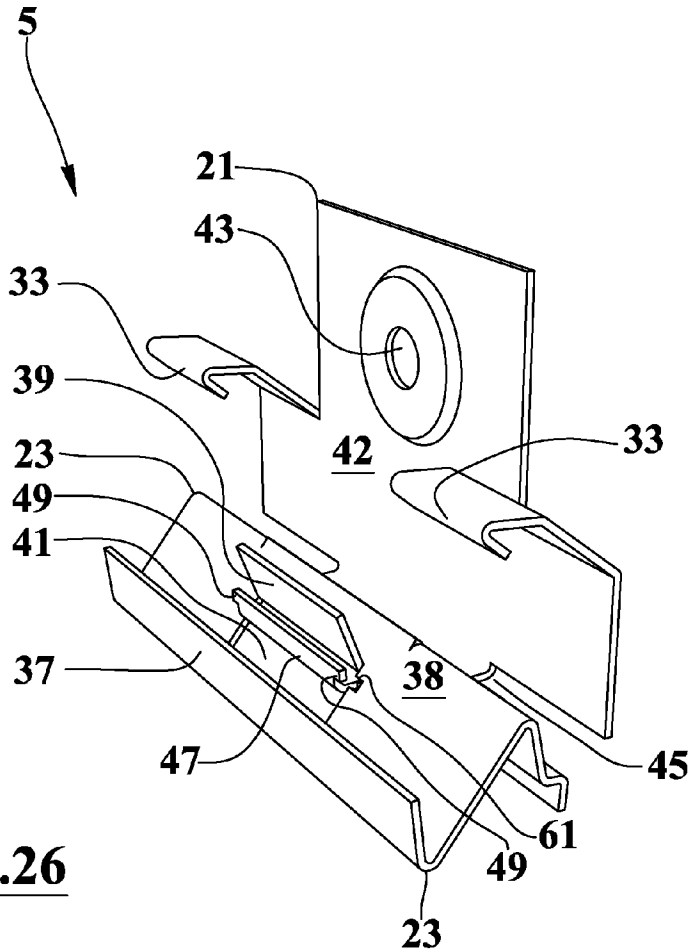
Figure 30:
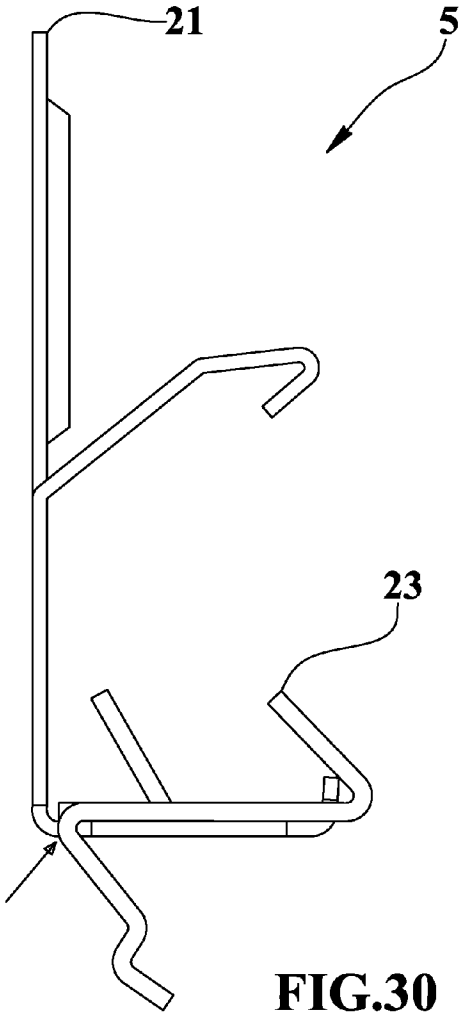
FIGS. 28-30 show lateral views of the removable connection means of FIG. 14 in conditions of mutual engagement and respectively unhooked, middle and interlocking.
Figure 29:
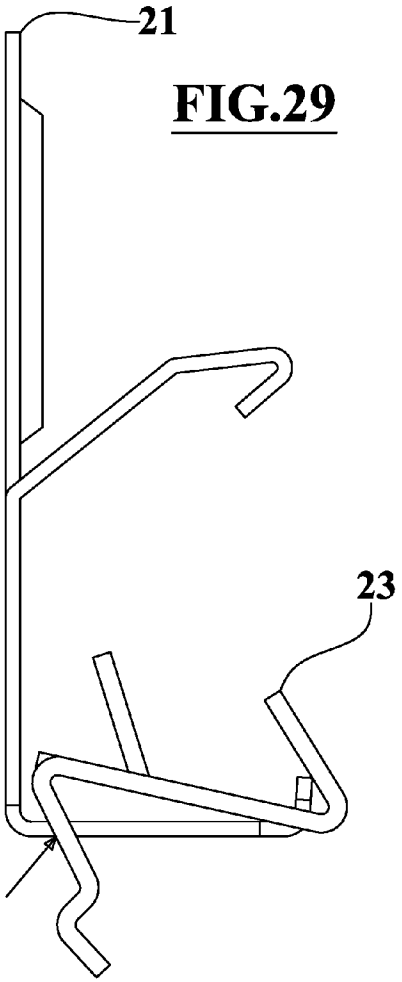
Figure 28:
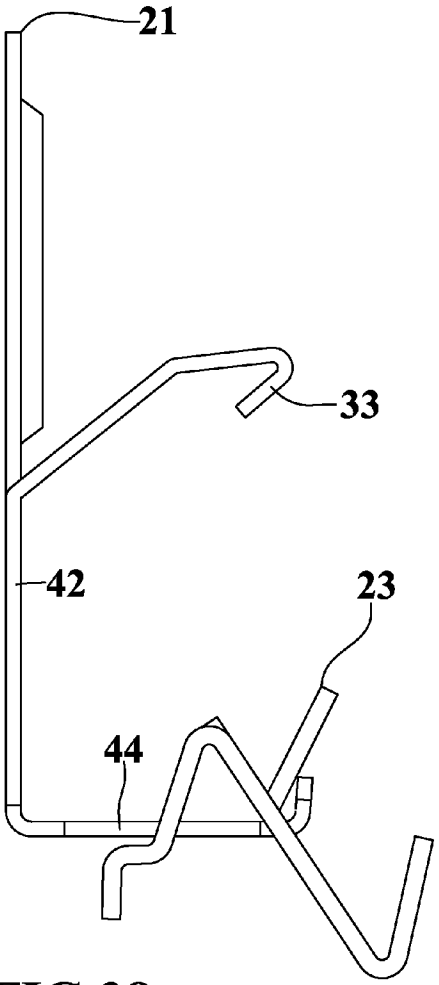
Figure 36:
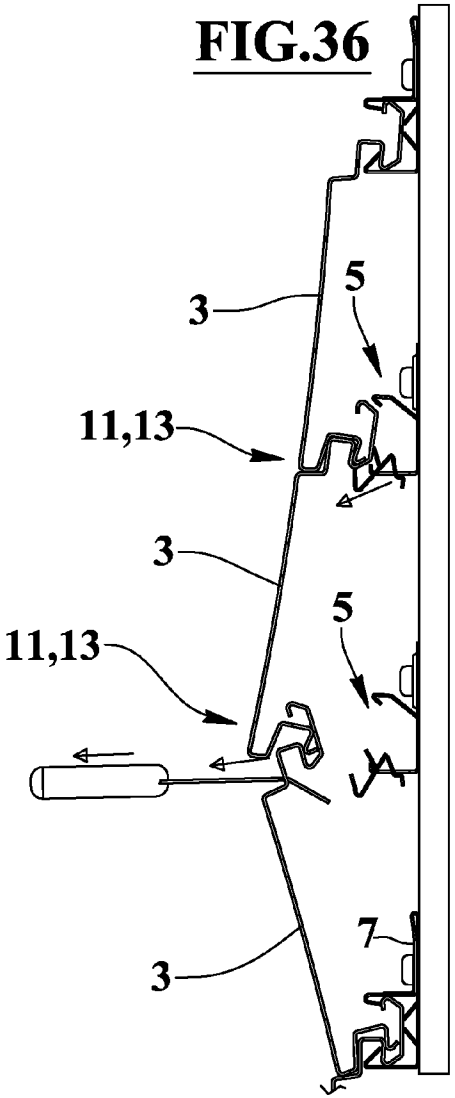
FIGS. 34-37 show lateral views of a possible sequence of disassembly of the middle panel of the configuration of FIG. 1.
Figure 35:
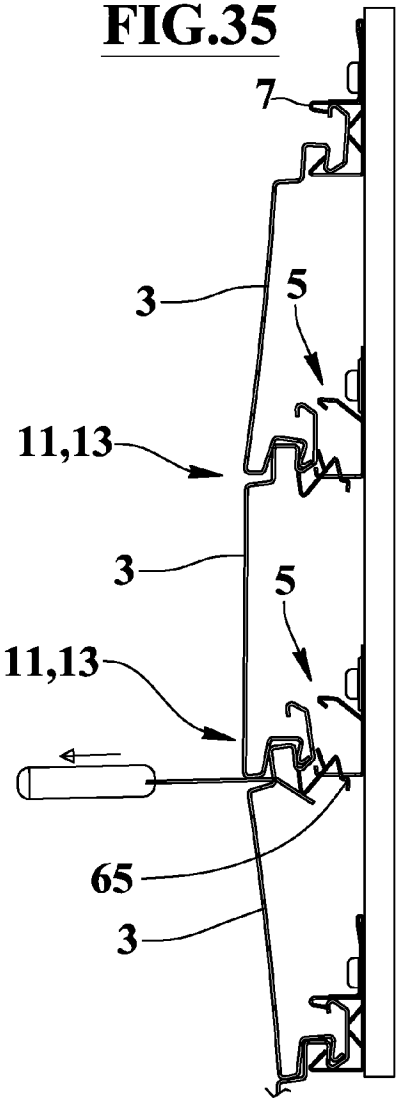
Figure 34:
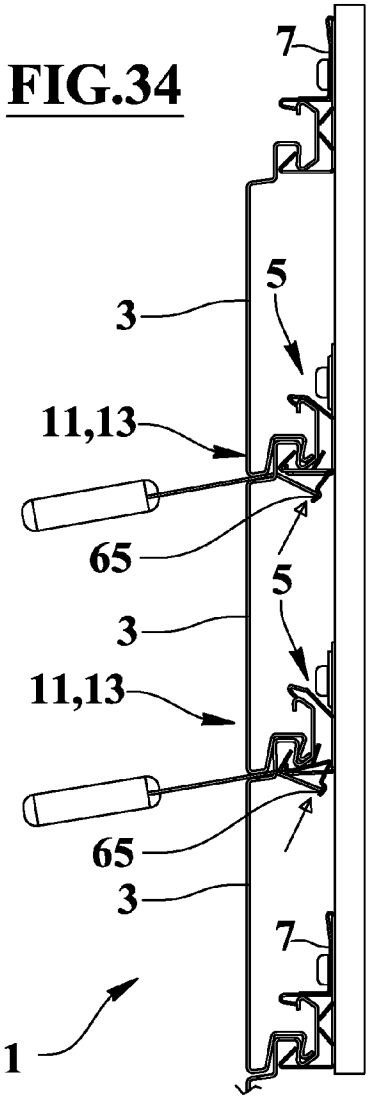
Figure 39:
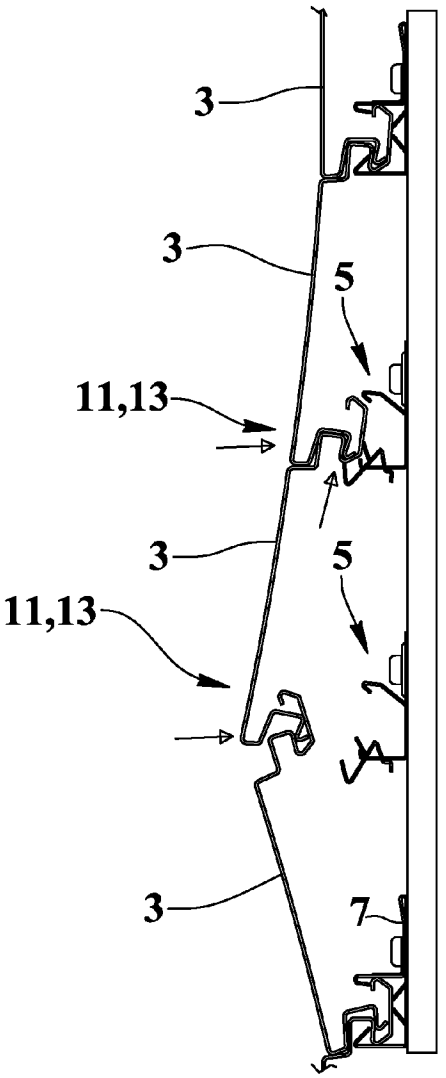
FIGS. 38-39 show lateral views of a possible sequence of reassembly of a middle panel of the configuration of the device of FIG. 37 of which they represent the continuation.
Figure 38:
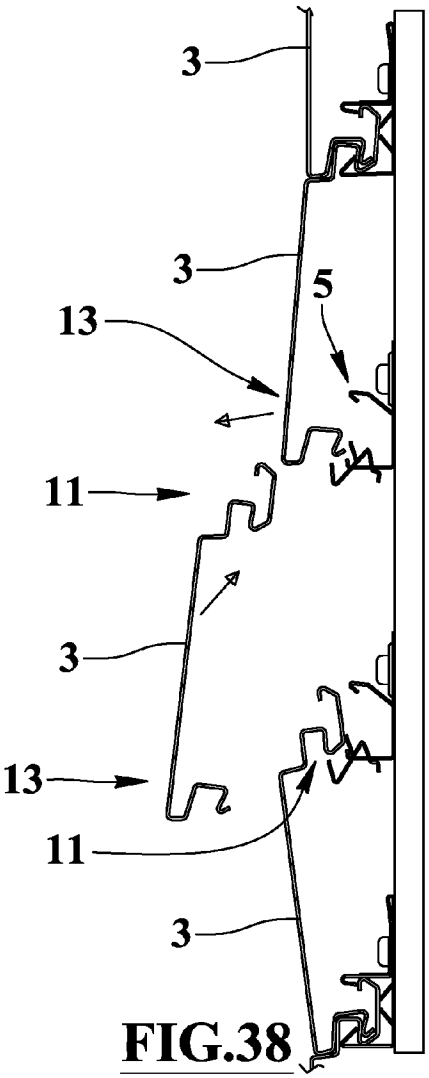
Figure 37:
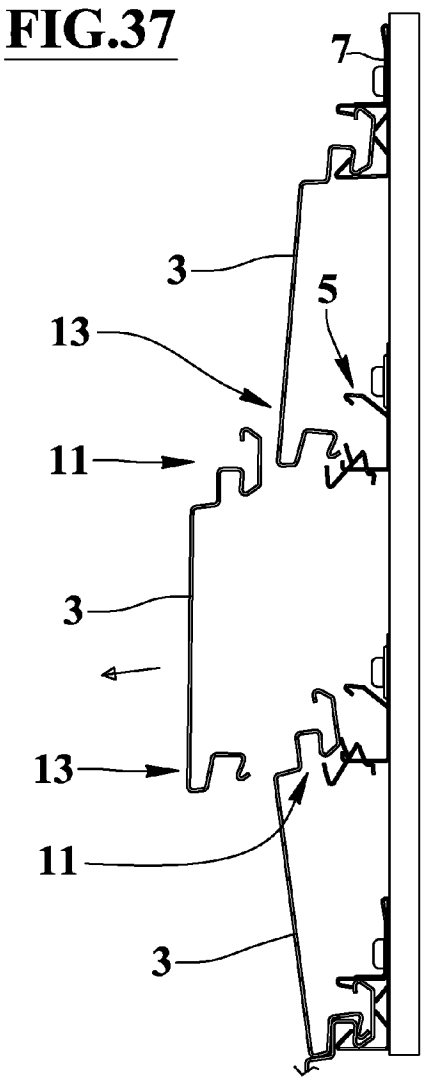

The covering obtained from such succession of edges fixed with removable fastening means 5 and with fixed fastenings 7, and these latter 7 shown in an exemplifying way in FIGS. 2 and 3, does not allow the direct disassembly of all of the panels, vice versa they need the disassembly of adjacent panels, but it is cheaper with respect to the one realized making use of only the removable fastening means 5.

With reference to said operative condition of two adjacent panels in which the first rib means 17 of one of them 3 is housed into the concave housing means 15 of the other one 3, each removable fastening means 5 comprises a locking means 21 which is lockable to the wall and matches with the first longitudinal edges 11 having said concave housing means 15 of one of the two adjacent panels 3.

Each removable fastening means 5 furthermore comprises a releasable clamping member 23 which is movable with respect to the corresponding locking means 21 and which can be interlockingly hooked and in a removable way with respect to the locking means 21 fixed to the wall with said concave housing means 15 of the first longitudinal edge 11 of a panel 3 containing the first rib means 17 of the second longitudinal edge 13 of the other panel 3.

The release of the releasable clamping member 23 from the respective locking means 21 of a plurality of removable fastening means 5 of the edges 11, 13 of two adjacent panels 3 allows to free such edges 11, 13.

Preferably the locking means 21 and the releasable clamping member 23 are made of a material having a certain level of elasticity and mechanical resistance to corrosion, for example made of zinced steel sheet or otherwise protected from the several forms of corrosion.

The concavity of the concave housing means 15 of each first longitudinal edge 11 is oriented to the opposite direction to the second longitudinal edge 13 of the corresponding panel 3 and the convexity of the first rib means 17 of the second longitudinal edge 13 of such panel 3 is oriented to the opposite direction to the first longitudinal edge 11 of the same panel 3.

Besides, this configuration allows in a preliminary way, during the assembly phase, to fix to the wall, by means of the fastening means 5, 7, the first longitudinal edge 11 of a panel 3 and to insert the first rib means 17 of the second longitudinal edge 13 of the upper adjacent panel into the concave housing means 15 of the longitudinal edge 11, fixed to the wall, of the lower panel constraining this way such edges mutually and to the wall.

Hereinafter the terms "external" and "internal" referred to elements or characteristics of the panels, of the fittings and of their members refer to the respective middle or central portions, with respectively the meaning of "distal" and "proximal".

The external longitudinal end of the first longitudinal edge 11 of each panel 3 has a respective second rib means 27 whose concavity is facing, opposing and spaced from the concavity of the concave housing means 15 of the same first longitudinal edge 11.

The transversal section of the second rib means 27 has the shape of a bevelled "V" or of a "U".

The longitudinal portion internal to the panel 3 with respect to the concave housing means 15 of the first longitudinal edge 11 has a first channel portion means 29 with section approximately "U" shaped or the like.

Such first channel portion means 29 is parallel and placed side by side inside the concave housing means 15 where the concavity of such concave housing means 15 and channel portion means 29 are placed side by side and opposing. The cross section of the portion of the first longitudinal edge 11 comprising the concave housing means 15 and the channel portion means 29 and it is approximately "S" or "5" shaped.

Such first channel portion means 29 has a complementary shape and can be housed into a longitudinal cavity of a second channel portion means 31, with section approximately "U" shaped, for example as "U" cursive capital letter, realized into the longitudinal portion of the second longitudinal edge 13 internal with respect to the first rib means 17 of the panel 3.

The concavities of the channel portion means first 29 and second 31 are faced and oriented towards the same direction.

Going back to the removable fastening means 5, the locking means 21 of each removable fastening means 5 comprises a respective plate-shaped body equipped with a respective protruding matching means 33, preferably constituted by two protruding arms, which are lateral and symmetrical, each having the respective free longitudinal edge or external end hook or rounded "V" or "U" shaped.

Each of such hooked ends of a locking means is assigned to match with, and to block, a corresponding second rib means 27, described previously, of the first longitudinal edge 11 of a panel 3. In particular the free longitudinal edge of the matching means 33 matches and blocks an external side face of the bevelled "V" or "U" shaped second rib means 27.

Each releasable clamping member 23 is equipped with protruding arm means first 37 and optional second 39. When the releasable clamping member 23 is interlockingly hooked to the respective locking means 21, the first arm means 37 is assigned to match with the concave wall of the first channel portion means 29 and/or with an outer face of the concave housing means 15 so as to fix to the wall said concave housing means 15 of the first longitudinal edge 11 of the respective panel 3 containing the first rib means 17 of the second longitudinal edge 13 of the other panel 3. The optional and protruding second arm means 39 cooperates with the first arm means 37 to form an interposed seat for the concave housing means 15 of said first longitudinal edge 11 and it 39 is assigned to match with an inner face or, in other words, with the face closer to the wall, of the concave housing means 15 or with a portion of the first longitudinal edge 11 comprised between the concave housing means 15 and the corresponding second rib means 27, for instance, to stiffen the fixing of the panels to the wall and/or to avoid or to limit the possible vibrations or oscillations of the panels.

Said plate-shaped body of each locking means 21 has a lateral outline approximately "L" shaped, having a main portion 42 corresponding to the leg of the L equipped with a hole 43 in the centre for a wall fitting means for example a screw plug and laterally provided with symmetrical protrusions which constitute the respective protruding matching means 33.

Each locking means 21 has as well a secondary portion 44 corresponding to the foot of the "L" perpendicular to the main portion.

The secondary portion 44, in correspondence with the junction with the main portion, has two side concave recesses 45 and, in correspondence with the end opposite to such recesses, has a ledge means 47 which protrudes in a parallel way to the main portion 42.

The free end of such ledge means 47 has two lateral protrusion means 49. The releasable clamping member 23 of each removable fastening means 5 comprises a respective plate-shaped body whose lateral outline is approximately "S" shaped and provided with:

- an upper portion corresponding to a final part of the "S", flat and constituting the first arm means 37;
- a median portion 38 flat and inclined with respect to the first arm means 37 and equipped in centre with a flat and protruding border, approximately parallel to the first arm means 37 and oriented in concordance with this latter 37; such flat border constitute the second arm means 39; said median portion 38 is besides equipped with a first window 41 carried out between the second arm means 39 and the first arm means 37; such first window 41 is assigned to be engaged by the ledge means 47 of the corresponding locking means 21;
- a lower portion 48, corresponding to the remaining final part of the "S", almost flat and parallel to the first arm means 37 and having in the centre a second window 51 assigned to be engaged by the part of the secondary portion 44 which is adjacent to the respective two side concave recesses 45.

The releasable clamping member 23 comprises seating means first 53 and second 55 comprised respectively between the first arm means 37 and the median portion 38 and between this latter 38 and the lower portion 48.

The cross section of such seating means first 53 and second 55 is V-shaped. When the releasable clamping member 23 is interlockingly hooked to the respective locking means 21, the ledge means 47 of the locking means 21 is housed into the first seating means 53 of the releasable clamping member 23 and edges of the concave recesses 45 of the locking means 21 are housed into the second seating means 55 of the releasable clamping member 23 and elastically and in a reversible way kept therein by the lower portion 48 of the releasable clamping member 23 and/or vice versa.

It is possible to modulate the intensity of the force necessary to the disengagement of the ledge means 47 and of the edges of the concave recesses 45 from the seating means first 53 and second 55 and thus necessary to release mutually the locking means 21 and the releasable clamping member 23 setting appropriately the measurement and/or the thicknesses and/or the modulus or elasticity of the material or of the materials with which they are made of.

The force necessary to unhook the panels to disassemble, even partially, the device will depend on said setting of the dimensional and physical parameters of the removable fastening means 5.

A side of the first window 41 is constituted by the side of the second arm means 39 fixed to the median portion 38 and such first window 41 has at least at one end of such side a notch or enlargement 61 assigned to facilitate the passage of a respective lateral protrusion means 49 of the ledge means 47.

The portion of the second window 51 close to the median portion 38 of the releasable clamping member 23 has a width approximately equal to the width of the part of the secondary portion 44 comprised between the two concave recesses 45.

The remaining portion of the second window 51, or its portion opposed to the median portion 38 of the releasable clamping member 23, has a width approximately equal or lightly superior to the maximum width of said of the secondary portion 44 of the locking means 21.

The edge of the second window 51 adjacent to the median portion 38 can have an optional bracket means 63.

The optional bracket means 63 is coplanar to the median portion 38 of the releasable clamping member 23 and it is assigned to occupy part of the joint area between its portions main 42 and secondary 44 of the locking means 21 without matching with this latter 21.

The lower portion 48 of the releasable clamping member 23 of each of the removable fastening means 5 has a ribbing or lever point 65 for the operation of a disassembling tool, for example provided with a handle for a stem whose portion opposite to the handle is angular.

Each panel 3 has at least a hole in a prefixed position of each releasable clamping member 23. Such hole is assigned to the passage of the stem of the tool up to the ribbing 65. Acting with the tool on such ribbing 65, the release of the removable fastening means 5 is caused releasing the respective edges of the corresponding panels 3.

Each of said fixed optional fastening means 7, comprises a plate-shaped body having a first hole for a wall-fitting means and whose lateral outline is approximately L-shaped.

Such body has an end portion partially folded 71 and flexible having a second hole side by side to the first one and a first stop means 73.

The opposite end of the body has a second stop means 75 and the portion of the body comprised between the second stop means 75 and the part of the body itself facing the upper end portion partially folded 71 has a plurality of protruding pushing means 77, for example consisting of protruding fins and angular with respect to the body.

Such stop means first 73 and second 75 and pushing means 77 are assigned, in a fixing condition of the fixed fastening means 7 to a wall by means of fixing means engaged in said two holes, to match with the first longitudinal edge 11 of a panel 3 and to shut such edge 11 as a result of the screwing of a screw, engaged in said holes of the fixed fastening means 7, of a wall-fitting expansion plug or of a self-perforating screw in the event of fixing to a metal structure.

The first stop means 73 are hook-shaped or rounded "V" or "U" shaped and the longitudinal edge thereof is assigned to match and to block an external side face of the bevelled "V" or "U" shaped second rib means 27.

The operation of the device provides that it could be installed fixing the panels to a part by means of the fastenings 5, 7 and that such panels could be disassembled acting with the tool at least on the releasable clamping member 23 of the removable fastening means 5 of the constraint of the edges of two panels and eventually also on some fixed fastenings means 7 if present and if necessary.

It must be observed that the locking means 21 and the releasable clamping member 23 of the removable fastening means 5 for the edges, which mutually match, of two adjacent panels can be mutually moved up to their mutual interlocking removable hooking and thus up to the fixing of such edges, simply by manually pushing such panels or edges towards the wall or the ceiling.

It must be also observed that the longitudinal cavity of the first longitudinal edge 11 fixed to a wall by means of the fixed fastening means 7, and thus free of holes or slots for the mounting tool, works as a drain joint.

Figure 40:
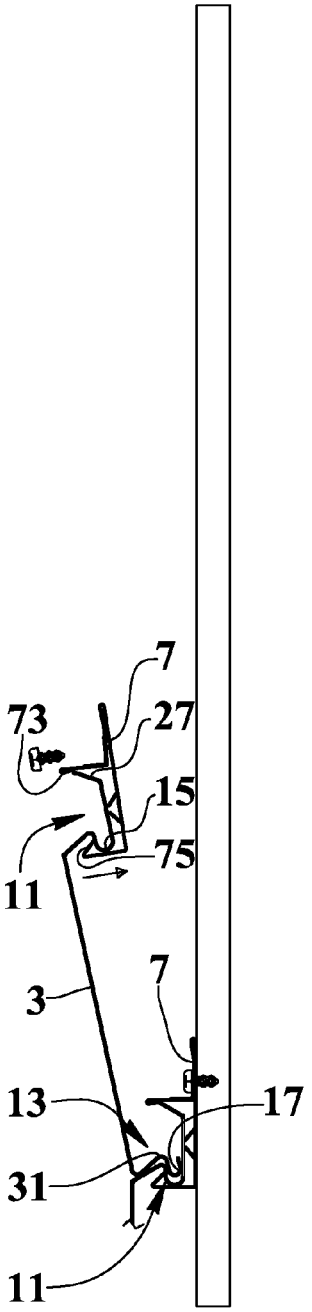
FIGS. 40-42 show lateral views of a possible sequence of installation of a possible configuration of the device with three panels provided with a variant of longitudinal edges and with variants of the fixed fastenings and of a removable fastening means.
Figure 41:
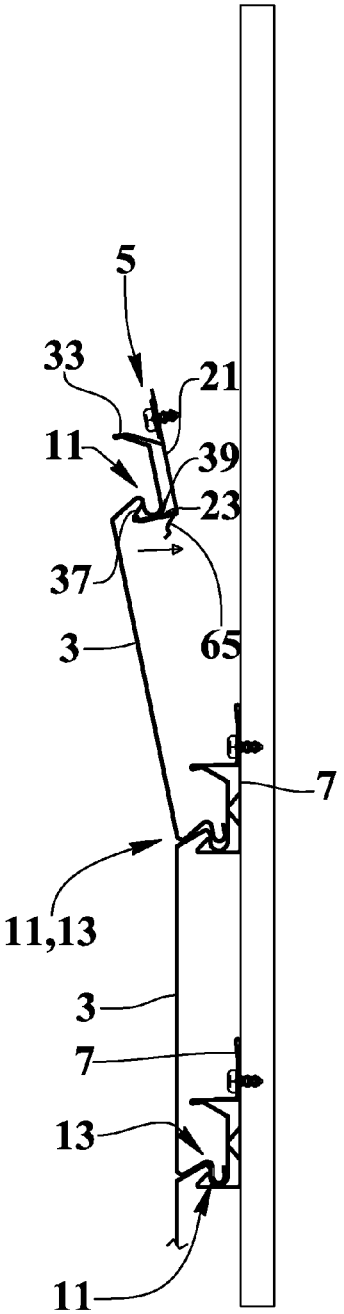
Figure 42:
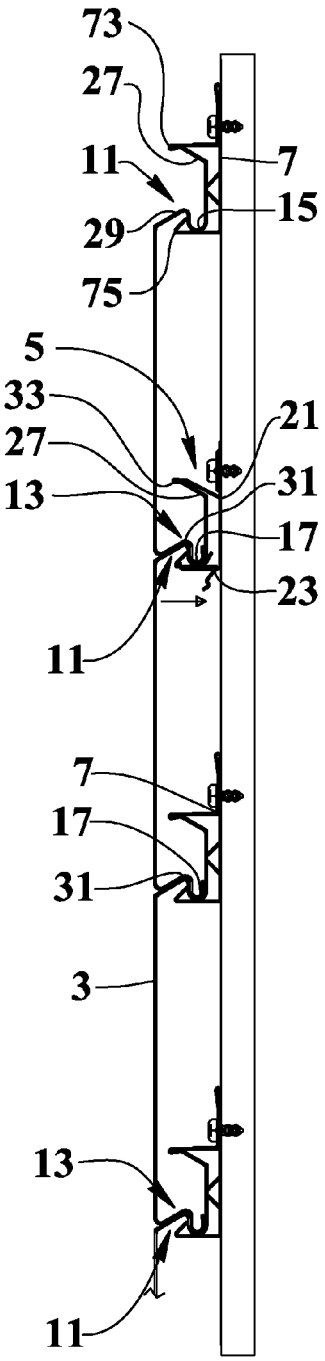

The cladding system or, in other words, the removable coating device of FIGS. 40-42 comprises variants of the panels, of the fixed fastenings and of the removable fastening means.

The longitudinal edges first 11 and second 13 of each panel 3, respectively, have a rounded concave housing means 15 and a rounded first rib means 17, the shape of the latter 17 is approximately complementary to the hollow of the concave housing means 15.

The longitudinal edges of the protruding matching means 33 of the removable fastening means 5 and of the first stop means 73 of the fixed fastenings 7 are 180° or more bended to form, at their longitudinal end portions, respective shoulders assigned to match with and to block the longitudinal end of the respective second rib means 27. The cross section of the second rib means 27 has the shape of an opened "V" or a "V" with enlarged angle so the respective longitudinal free edge can face and can match with the shoulders formed by the matching means 33 and by the first stop means 73.

The invention claimed is:

1. Removable cladding system for a wall comprising a plurality of panels (3) where longitudinal edges of two adjacent panels (3) are blocked to each other and to the wall by a respective plurality of fastenings (5, 7); each panel (3) is provided with a first longitudinal edge (11) and with a second longitudinal edge (13) parallel to the first longitudinal edge (11) which bears at least one concave housing means (15) and the second longitudinal edge (13) bears a first rib means (17) whose shape is approximately complementary to that of the concave housing means (15) in which (15) is insertable said first rib means (17) and at least one of the plurality of the fastenings (5, 7) for the edges of two adjacent panels (3), where the first rib means (17) of one of said panels (3) is housed into the concave housing means (15) of the other (3), the fastening is formed at least by a set of removable fastening means (5) each comprising a locking means (21) lockable to the wall and abutting with the first longitudinal edge (11) bearing said concave housing means (15) of one of the two adjacent panels (3) and each removable fastening means (5) comprises a releasable clamping member (23) movable with respect to the corresponding locking means (21) and removably joinable to the latter (21); wherein said clamping member (23) is provided with at least one protruding first arm means (37) assigned, when the releasable clamping member (23) is interlockingly hooked to the respective locking means (21), to abut and match with the concave housing means (15) so as to fix to the wall said concave housing means (15) of the first longitudinal edge (11) of the respective panel (3) containing the first rib means (17) of the second longitudinal edge (13) of the other panel (3); the release of the releasable clamping member (23) by the respective locking means (21) of said plurality of removable fastening means (5) for the edges (11, 13) of the two adjacent panels (3) allows to release said edges (11, 13).

2. Cladding system according to claim 1 wherein the concavity of the concave housing means (15) of each first longitudinal edge (11) is directed in a direction opposite to the second longitudinal edge (13) of the corresponding panel (3) and the convexity of the first rib means (17) of the second longitudinal edge (13) of said panel (3) is directed in a direction opposite to the first longitudinal edge (11) of the same panel (3).

3. Cladding system according to claim 2 wherein an outer longitudinal end of the first longitudinal edge (11) of each panel (3) bears a respective second rib means (27) whose concavity is facing, opposing, and spaced from the concavity of the concave housing means (15) of the same first longitudinal edge (11).

4. Cladding system according to claim 3 a longitudinal portion of each panel (3) that is inner in respect to the concave housing means (15) of the first longitudinal edge (11) bears a first channel portion means (29) having a substantially "U" section shape, said first channel portion means (29) is parallel and placed internally and side by side in respect to the concave housing means (15) where the concavity of said concave housing means (15) and channel portion means (29) are side by side and opposite, said first channel portion means (29) is complementarily shaped or housed in a longitudinal cavity of a second channel portion means (31) also having a substantially "U" shaped section, made in the longitudinal portion of the second longitudinal edge (13) that is inner in respect to the first rib means (17) of the panel (3); the concavity of the first (29) and second (31) channel portion means are faced and pointing in the same direction.

5. Removable cladding system for a wall comprising a plurality of panels (3) where longitudinal edges of two adjacent panels (3) are blocked to each other and to the wall by a respective plurality of fastenings (5, 7); each panel (3) is provided with a first longitudinal edge (11) and with a second longitudinal edge (13) parallel to the first longitudinal edge (11) which bears at least one concave housing means (15) and the second longitudinal edge (13) bears a first rib means (17) whose shape is approximately complementary to that of the concave housing means (15) in which (15) is insertable said first rib means (17) and at least one of the plurality of the fastenings (5, 7) for the edges of two adjacent panels (3), where the first rib means (17) of one of said panels (3) is housed into the concave housing means (15) of the other (3), the fastening is formed at least by a set of removable fastening means (5) each comprising a locking means (21) lockable to the wall and abutting with the first longitudinal edge (11) bearing said concave housing means (15) of one of the two adjacent panels (3) and each removable fastening means (5) comprises a releasable clamping member (23) movable with respect to the corresponding locking means (21) and removably joinable to the latter (21); wherein said clamping member (23) is provided with at least one protruding first arm means (37) assigned, when the releasable clamping member (23) is interlockingly hooked to the respective locking means (21), to match with the concave housing means (15) so as to fix to the wall said concave housing means (15) of the first longitudinal edge (11) of the respective panel (3) containing the first rib means (17) of the second longitudinal edge (13) of the other panel (3); the release of the releasable clamping member (23) by the respective locking means (21) of said plurality of removable fastening means (5) for the edges (11, 13) of the two adjacent panels (3) allows to release said edges (11, 13), wherein the concavity of the concave housing means (15) of each first longitudinal edge (11) is directed in a direction opposite to the second longitudinal edge (13) of the corresponding panel (3) and the convexity of the first rib means (17) of the second longitudinal edge (13) of said panel (3) is directed in a direction opposite to the first longitudinal edge (11) of the same panel (3), wherein an outer longitudinal end of the first longitudinal edge (11) of each panel (3) bears a respective second rib means (27) whose concavity is facing, opposed, and spaced from the concavity of the concave housing means (15) of the same first longitudinal edge (11), wherein a longitudinal portion of each panel (3) that is inner in respect to the concave housing means (15) of the first longitudinal edge (11) bears a first channel portion means (29) having a substantially "U" section shape, said first channel portion means (29) is parallel and placed internally and side by side in respect to the concave housing means (15) where the concavity of said concave housing means (15) and channel portion means (29) are side by side and opposite, said first channel portion means (29) is complementarily shaped or housed in a longitudinal cavity of a second channel portion means (31) also have a substantially "U" shaped section, made in the longitudinal portion of the second longitudinal edge (13) that is inner in respect to the first rib means (17) of the panel (3); the concavity of the first (29) and second (31) channel portion means are faced and pointing in the same direction, wherein each locking means (21) is provided with a respective protruding matching means (33) an outer end of which is hook-shaped or shoulder shaped and is assigned to abut with, and to block, a corresponding rib of said respective second rib means (27) of the first longitudinal edge (11) of a panel (3); each releasable clamping member (23) is provided with the first arm mean (37) and with a second arm mean (39) both protruding and defining therebetween a seat for the concave housing means (15) of said first longitudinal edge (11), when the releasable clamping member (23) is coupled to the respective locking means (21), the first arm means (37) is assigned to match with the concave part of first channel portion means (29) and the second arm means (39) is assigned to match with the concave housing means (15) or with a portion of the first longitudinal edge (11) between the concave housing means (15) and the corresponding second rib means (27).

6. Cladding system according to claim 5 wherein the locking means (21) of each removable fastening means (5) comprises a respective plate-shaped body whose side profile is substantially "L" shaped, having a main portion (42) corresponding to a leg of the "L" centrally provided with a hole (43) for a wall fixing means and laterally provided with symmetrical projections constituting the respective protruding matching means (33) and said locking means (21) having a secondary portion (44) corresponding to a foot of the "L" perpendicular to the main portion and bearing in correspondence of a union with such main portion two side concave recesses (45) and having at an end opposite to these recesses a ledge means (47) protruding parallel to the main portion (42) and a free end of said ledge means (47) bearing two lateral protrusion means (49); wherein the releasable clamping member (23) of each removable fastening means (5) comprises a respective plate-shaped body having a side profile that is substantially "S" shaped with an upper portion, corresponding to a first terminal section of the "S" shaped profile, that is flat and forming the first arm means (37), the side profile of the releasable clamping member (23) having a median portion (38) flat and sloping in respect to the first arm means (37) and centrally provided with a protruding plane flap parallel to, and directed in accordance with, the first arm means (37) and forming the second arm means (39) and said median portion (38) has first window (41) carried out between the second arm means (39) and the first arm means (37) and assigned to be engaged by the ledge means (47) of the corresponding locking means (21), said releasable clamping member (23) furthermore has lower portion (48), corresponding to a remaining second terminal section of the "S", almost flat and parallel to the first arm means (37) and centrally bearing a second window (51) assigned to be engaged by the secondary portion (44); wherein the releasable clamping member (23) comprises a first seating means (53) and a second seating means (55) comprised respectively between the first arm means (37) and the median portion (38) and between the latter (38) and the lower portion (48); when the releasable clamping member (23) is releasably hooked to the respective locking means (21), the ledge means (47) of the locking means (21) is housed in the first seating means (53) of the releasable clamping member (23) and edges of the two side concave recesses (45) of the locking means (21) are housed in the second seating means (55) of the releasable clamping member (23) and here elastically and reversibly retained by the lower portion (48) of the releasable clamping member (23).

7. Cladding system according to claim 6 wherein one side of the first window (41) is constituted by the side of the second arm means (39) fixed to the median portion (38) and said first window (41) bears at least to one end side of such notch or enlargement (61) to facilitate a transition of a respective lateral protrusion means (49) of the ledge means (47).

8. Cladding system according to claim 6 wherein a portion of the second window (51) next to the median portion (38) of the releasable clamping member (23) has a width substantialy equal to the width of a part of the secondary portion (44) between the two side concave recesses (45) and a remaining portion of the second window (51) has a width substantially equal to or slightly greater than a maximum width of said secondary portion (44).

9. Cladding system according to claim 6 wherein the lower portion (48) of the releasable clamping member (23) of each removable fastening means (5) bears a ribbing or lever point (65) for a tool and that each panel (3) bears at least a hole at a corresponding portion of each releasable clamping member (23) to permit access and engagement of the tool with the ribbing or lever point (65) so that the tool causes release of the removable fastening means (5) and thereby releases the edges of the corresponding panels (3).

10. Removable cladding system for a wall comprising a plurality of panels (3) where longitudinal edges of two adjacent panels (3) are blocked to each other and to the wall by a respective plurality of fastenings (5, 7); each panel (3) is provided with a first longitudinal edge (11) and with a second longitudinal edge (13) parallel to the first longitudinal edge (11) which bears at least one concave housing means (15) and the second longitudinal edge (13) bears a first rib means (17) whose shape is approximately complementary to that of the concave housing means (15) in which (15) is insertable said first rib means (17) and at least one of the plurality of the fastenings (5, 7) for the edges of two adjacent panels (3), where the first rib means (17) of one of said panels (3) is housed into the concave housing means (15) of the other (3), the fastening is formed at least by a set of removable fastening means (5) each comprising a locking means (21) lockable to the wall and abutting with the first longitudinal edge (11) bearing said concave housing means (15) of one of the two adjacent panels (3) and each removable fastening means (5) comprises a releasable clamping member (23) movable with respect to the corresponding locking means (21) and removably joinable to the latter (21); wherein said clamping member (23) is provided with at least one protruding first arm means (37) assigned, when the releasable clamping member (23) is interlockingly hooked to the respective locking means (21), to match with the concave housing means (15) so as to fix to the wall said concave housing means (15) of the first longitudinal edge (11) of the respective panel (3) containing the first rib means (17) of the second longitudinal (13) of the other panel (3); the release of the releasable clamping member (23) by the respective locking means (21) of said plurality of removable fastening means (5) for the edges (11, 13) of the two adjacent panels (3) allows said edges (11, 13), wherein at least one of the plurality of fastenings (5, 7) for the edges of the two adjacent panels (3) comprises fixed fastenings (7) each comprising a plate-shaped body having a first hole for a wall fixing means, each fixed fastening having a side profile that is substantially "L" shaped, wherein said body has an end portion partially folded (71) and flexibly bearing a second hole faced to the first and a first stop means (73); wherein an opposite end of the body bears a second stop means (75) and a portion of the body between the second stop means (75) and a part facing to the folded portion (71) bears a plurality of protruding push means (77); wherein said first stop means (73), said second stop means (75), and said pushing (77) means engage the first longitudinal edge (11) of a panel (3) to the fixed fastening (7) that is fastened to a wall by fixing means.

* * * * *